US007806104B2

(12) United States Patent
Sadakane et al.

(10) Patent No.: US 7,806,104 B2
(45) Date of Patent: Oct. 5, 2010

(54) CONTROL APPARATUS FOR INTERNAL COMBUSTION ENGINE

(75) Inventors: Shinji Sadakane, Susono (JP); Motoki Ohtani, Toyota (JP); Kazutaka Fujioka, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 1 day.

(21) Appl. No.: 11/474,343

(22) Filed: Jun. 26, 2006

(65) Prior Publication Data

US 2007/0000478 A1 Jan. 4, 2007

(30) Foreign Application Priority Data

Jun. 30, 2005 (JP) ..... 2005-192047

(51) Int. Cl.
*F02D 41/00* (2006.01)

(52) U.S. Cl. ..... 123/339.24; 123/339.1; 123/431; 701/104

(58) Field of Classification Search ..... 123/431, 123/339.24, 300, 502, 339.1; 701/104, 113
See application file for complete search history.

(56) References Cited

U.S. PATENT DOCUMENTS

| | | | | |
|---|---|---|---|---|
| 5,277,156 | A | 1/1994 | Osuka et al. | |
| 5,605,128 | A | 2/1997 | Nusser et al. | |
| 5,642,716 | A * | 7/1997 | Ricco | 123/456 |
| 6,640,788 | B2 * | 11/2003 | Inoue et al. | 123/506 |
| 6,928,983 | B2 * | 8/2005 | Mashiki | 123/431 |
| 2004/0007213 | A1 | 1/2004 | Oono | |
| 2004/0194737 | A1 * | 10/2004 | Miyashita | 123/48 C |
| 2005/0072405 | A1 | 4/2005 | Kojima et al. | |
| 2005/0235958 | A1 | 10/2005 | Matsumura | |

FOREIGN PATENT DOCUMENTS

| | | | |
|---|---|---|---|
| EP | 0 501 463 | A2 | 9/1992 |
| EP | 1 520 981 | A2 | 4/2005 |
| JP | A 8-114145 | | 5/1996 |
| JP | A 9-158766 | | 6/1997 |
| JP | A-2000-8916 | | 1/2000 |
| JP | A-2001-041088 | | 2/2001 |
| JP | A-2002-213326 | | 7/2002 |
| JP | 2002364409 | A * | 12/2002 |

OTHER PUBLICATIONS

U.S. Appl. No. 11/447,025, filed Jun. 6, 2006 in the name of Takeshi Iwahashi.
Jan. 12, 2010 Office Action issued in Japanese Patent Application No. 2005-192047 (with translation).

* cited by examiner

*Primary Examiner*—Stephen K Cronin
*Assistant Examiner*—J. Page Hufty
(74) *Attorney, Agent, or Firm*—Oliff & Berridge, PLC

(57) ABSTRACT

An engine ECU executes a program including the steps of: detecting an engine speed NE, engine load, and engine coolant temperature (S100, S110, S115); when determination is made of being in an idle region (YES at S120), determining whether in a cold idle region, a transitional region, or a warm idle region (S130); injecting fuel from an intake manifold injector alone when in the cold idle region (S140); injecting fuel from the intake manifold injector and injecting fuel from an in-cylinder injector at the feed pressure when in the transitional region (S150); and injecting fuel from the in-cylinder injector at the feed pressure when in the warm idle region (S160).

18 Claims, 10 Drawing Sheets

| | FAST IDLE AFTER STARTING | COLD IDLE | WARM IDLE | HIGH TEMPERATURE IDLE |
|---|---|---|---|---|
| IDLE OPERATION | DI (HIGH PRESSURE) | PFI (FEED PRESSURE) | DI (FEED PRESSURE) OR DIVISIONAL (FEED PRESSURE) | DI (HIGH PRESSURE) |

FIG. 6
| | FAST IDLE AFTER STARTING | COLD IDLE | WARM IDLE | HIGH TEMPERATURE IDLE |
|---|---|---|---|---|
| IDLE OPERATION | DI (HIGH PRESSURE) | PFI (FEED PRESSURE) | DI (FEED PRESSURE) OR DIVISIONAL (FEED PRESSURE) | DI (HIGH PRESSURE) |
FIG. 7
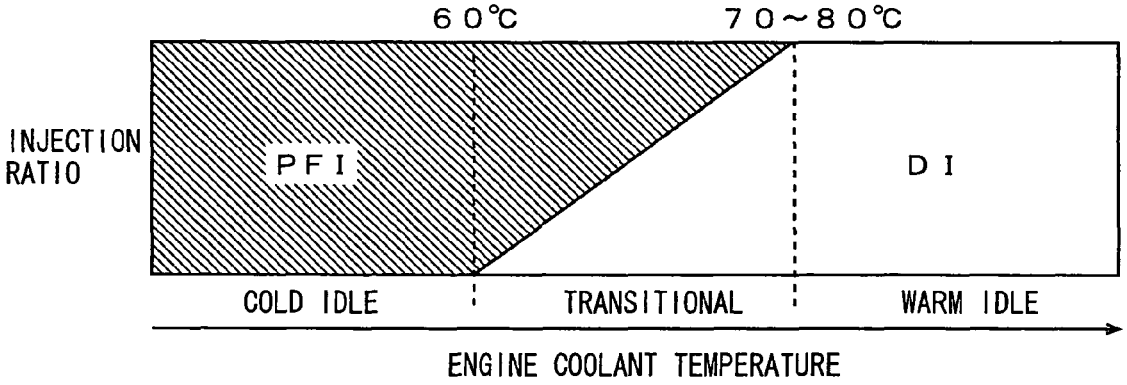
FIG. 8
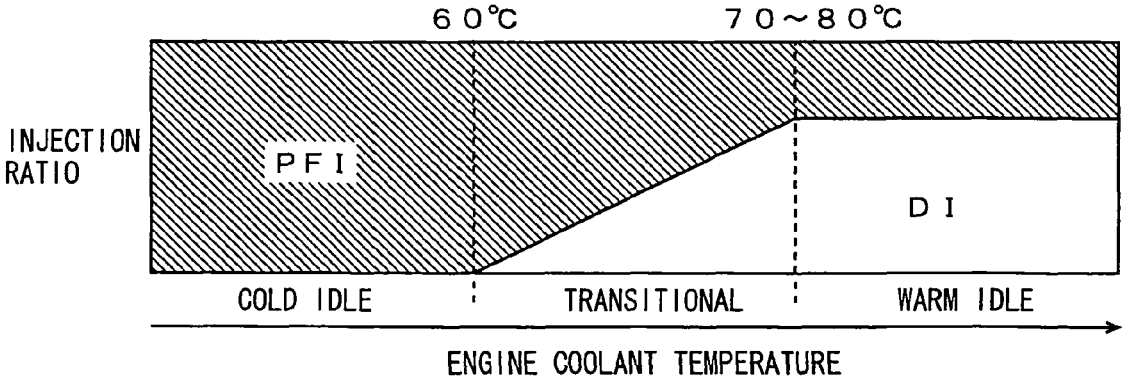

CONTROL APPARATUS FOR INTERNAL COMBUSTION ENGINE

This nonprovisional application is based on Japanese Patent Application No. 2005-192047 filed with the Japan Patent Office on Jun. 30, 2005, the entire contents of which are hereby incorporated by reference.

BACKGROUND OF THE INVENTION

1. Field of the Invention

The present invention relates to a control apparatus for an internal combustion engine including a fuel injection mechanism (in-cylinder injector) injecting fuel at high pressure into a cylinder, or an internal combustion engine including, in addition to the aforementioned fuel injection mechanism, another type of a fuel injection mechanism (intake manifold injector) injecting fuel towards an intake manifold or intake port. Particularly, the present invention relates to control of an internal combustion engine in an idling mode.

2. Description of the Background Art

There is known an engine including a first fuel injection valve (in-cylinder injector) for injecting fuel into the combustion chamber of a gasoline engine and a second fuel injection valve (intake manifold injector) to inject fuel into an intake manifold, wherein the in-cylinder injector and the intake manifold injector partake in fuel injection according to the engine speed and internal combustion engine load. There is also known a direct injection engine including only a fuel injection valve (in-cylinder injector) to inject fuel into the combustion chamber of the gasoline engine. In a high-pressure fuel system including an in-cylinder injector, fuel having pressure increased by a high-pressure fuel pump is supplied to the in-cylinder injector via a delivery pipe, whereby the in-cylinder injector injects high-pressure fuel into the combustion chamber of each cylinder in the internal combustion engine.

Further, there is also known a diesel engine with a common rail type fuel injection system. In the common rail type fuel injection system, fuel having pressure increased by a high-pressure fuel pump is stored at the common rail. High-pressure fuel is injected into the combustion chamber of each cylinder in the diesel engine from the common rail by opening/closing an electromagnetic valve.

For the purpose of generating such high-pressure fuel, a high-pressure fuel pump that drives a cylinder through a cam provided at a drive shaft coupled to a crankshaft of the internal combustion engine is employed. The high-pressure fuel pump includes a pump plunger that reciprocates in a cylinder by the rotation of the cam, and a pressurizing chamber formed of the cylinder and pump plunger. To this pressurizing chamber are connected a pump supply pipe communicating with a feed pump that feeds fuel from a fuel tank, a return pipe to return the fuel flowing out from the pressurizing chamber into the fuel tank, and a high-pressure delivery pipe to deliver the fuel in the pressurizing chamber towards the in-cylinder injector. The high-pressure fuel pump is provided with an electromagnetic spill valve for opening/closing the pump supply pipe and high-pressure delivery pipe with respect to the pressurizing chamber.

When the electromagnetic spill valve is open and the pump plunger moves in the direction of increasing the volume of the pressurizing chamber, i.e. when the high-pressure fuel pump is in an intake stroke, fuel is drawn from the pump supply pipe into the pressurizing chamber. When the pump plunger moves in the direction of reducing the volume of the pressurizing chamber, i.e. when the high-pressure fuel pump is in a delivery stroke, and the electromagnetic spill valve is closed, the pump supply pipe and return pipe are cut from the pressurizing chamber, and the fuel in the pressurizing chamber is delivered to the in-cylinder injector via the high-pressure delivery pipe.

Since fuel is delivered towards the in-cylinder injector only during the period where the electromagnetic spill valve is closed in the delivery stroke in accordance with the high-pressure fuel pump, the amount of fuel pumped out can be adjusted by controlling the time to start closing the electromagnetic spill valve (adjusting the closing period of the electromagnetic spill valve). Specifically, the amount of fuel pumped out is increased by setting the time to start closing the electromagnetic spill valve earlier to increase the valve-closing period. The amount of fuel pumped out can be reduced by retarding the time to start closing the electromagnetic spill valve to shorten the valve-closing period.

By applying pressure to the fuel output from the feed pump with the high-pressure fuel pump and delivering the pressurized fuel towards the in-cylinder injector, fuel injection can be effected appropriately even for an internal combustion engine that injects fuel directly into the combustion chamber.

When the electromagnetic spill valve is to be closed in the delivery stroke of the high-pressure fuel pump, the fuel will flow, not only towards the high-pressure delivery pipe, but also towards the return pipe since the volume of the pressurizing chamber is currently reduced. If the electromagnetic spill valve is to be closed under such a state, the force by the fuel that will flow as set forth above is urged in the closing-valve operation, increasing the impact force when the electromagnetic spill valve is closed. Reflecting this increase in impact, the operation noise of the electromagnetic spill valve (the noise of the closing valve) will also become larger. This operation noise of the electromagnetic spill valve will occur continuously every time the electromagnetic spill valve is closed.

During a normal operation mode of the internal combustion engine, the continuous operation noise caused by every closing of the electromagnetic spill valve is not so disturbing since the operation noise of the internal combustion engine such as the combustion noise of the air-fuel mixture is relatively large. However, when the operation noise of the internal combustion engine per se is small such as in an idling mode of the internal combustion engine, the continuous operation noise of the electromagnetic spill valve will become so audible that the disturbance thereof can no longer be neglected.

Japanese Patent Laying-Open No. 2001-41088 discloses a fuel pump control device that can have the continuous operation noise caused at every closing of the electromagnetic spill valve reduced. The control device disclosed in this publication includes a fuel pump that draws in fuel into the pressurizing chamber and delivers the fuel towards the fuel injection valve of the internal combustion engine by altering the volume of the pressurizing chamber based on the relative movement between the cylinder and pump plunger caused by the rotation of the cam, and a spill valve for opening/closing the communication between the pressurizing chamber and the spill channel from which the fuel flows out from the pressurizing chamber. The amount of fuel pumped out towards the fuel injection valve from the fuel pump is adjusted by controlling the spill valve closing period. By controlling the spill valve based on the operation state of the internal combustion engine, the number of times of pumping out fuel by the fuel pump during a predetermined period of time can be adjusted to alter the number of times of fuel injection through the fuel injection valve per one fuel delivery. The control device includes a control unit reducing the number of times of fuel injection per one fuel delivery in a low engine load mode.

In accordance with this fuel pump control device, the required amount of fuel delivered at one time is reduced since the number of times of fuel injection per one fuel delivery is reduced in a low engine load mode where the continuous operation noise of the electromagnetic spill valve becomes relatively large. Accordingly, the time to start closing the electromagnetic spill valve can be set at a time further closer to top dead center. The cam rate indicating the relative movement between the pump plunger and the cylinder becomes smaller as a function of approaching the top dead center. Accordingly, the cam rate at the time of closing the electromagnetic spill valve can be reduced to further lower the closing noise of the electromagnetic spill valve. By lowering the closing noise of the electromagnetic spill valve, the continuous operation noise cause at every closing operation of the electromagnetic spill valve can be reduced.

In an engine that includes a first fuel injection valve (in-cylinder injector) and a second fuel injection valve (intake manifold injector) to inject fuel into an intake manifold, a likely approach of reducing the number of times of fuel injection per one fuel delivery from the high-pressure fuel pump in a low engine load mode may be employed using the control device disclosed in the aforementioned publication. Accordingly, the operation noise of the high-pressure fuel pump when in an idle region can be reduced. In an idle region, combustion is apt to become unstable since the fuel pressure in fuel injection from the in-cylinder injector is low (fuel injection quantity is low). Therefore, combustion stabilization is ensured when in an idle region by injecting fuel through an intake manifold injector.

However, the possibility of deposits being accumulated at the injection hole of the in-cylinder injector subjected to combustion in the cylinder will become higher if fuel injection from the in-cylinder injector is stopped and fuel is injected from the intake manifold injector when the engine is in an idle region.

SUMMARY OF THE INVENTION

In view of the foregoing, an object of the present invention is to provide a control apparatus for an internal combustion engine that obviates generation of an operation noise from a high-pressure fuel pump, maintains stable combustion, and suppresses generation of deposits at the injection hole of a fuel injection mechanism during an idling mode of the internal combustion engine.

According to an aspect of the present invention, a control apparatus controls an internal combustion engine including a low-pressure pump that supplies fuel of low pressure and a high-pressure pump that supplies fuel of high pressure from a fuel tank to a fuel injection mechanism. The internal combustion engine includes a first fuel injection mechanism injecting fuel into a cylinder, and a second fuel injection mechanism injecting fuel into an intake manifold. The control apparatus includes a determination unit determining that an operation state of the internal combustion engine is in an idle state, and a control unit controlling the internal combustion engine. The control unit controls the low-pressure pump, the high-pressure pump, and the fuel injection mechanisms depending upon which of two or more predetermined idle states the idle state belongs to based on the temperature of the internal combustion engine.

In accordance with the present invention, determination is made that the operation state of the internal combustion engine is in an idle state based on, for example, the engine speed and the load state of the internal combustion engine. With regards to the idle state, it is predetermined which of two or more idle states the idle state belongs to according to the temperature of the internal combustion engine. The internal combustion engine is under control depending upon which of the idle states the current idle state belongs to. Specifically, in a cold idle state among the idle states, deposits are unlikely to be generated at the injection hole of the first fuel injection mechanism since the temperature is low. Therefore, combustion stability is given priority than obviating generation of deposits. The high-pressure pump is stopped and low-pressure fuel is injected from the second fuel injection mechanism alone. Thus, a favorable combustion state can be realized even when the temperature is low. In a warm idle state, the problem of combustion stability is less likely to occur since the temperature is not low. Therefore, avoiding generation of deposits is given priority than combustion stability. The high-pressure pump is stopped and low-pressure fuel is injected from the first fuel injection mechanism and/or the second fuel injection mechanism. The operation noise can be reduced since the high-pressure pump is stopped. Since fuel is injected from the second fuel injection mechanism when in a cold idle state, the time from fuel injection up to ignition is increased to improve atomization, whereby combustion can be stabilized. Further, since high-pressure fuel is injected from the first fuel injection mechanism when in a high temperature idle state, the temperature at the injection hole is reduced to obviate generation of deposits. Thus, there can be provided a control apparatus for an internal combustion engine that obviates generation of an operation noise of a high pressure pump, maintains stable combustion, and suppresses generation of deposits at the injection hole of the fuel injection mechanism when in an idling mode of the internal combustion engine.

Preferably, fuel can be supplied from the high-pressure pump and low-pressure pump to the first fuel injection mechanism. The control unit effects control such that the high-pressure pump is stopped or control such that the discharge pressure from the high-pressure pump is reduced when determination is made that the operation state is in an idle state, and effects control such that fuel is injected from the second fuel injection mechanism when in a cold idle state.

In accordance with the present invention, control is effected such that the high-pressure pump is stopped or such that the discharge pressure from the high-pressure pump is reduced when in a cold idle state. Therefore, generation of the operation noise of the high-pressure pump when the internal combustion engine is in an idling mode can be obviated. Further, since fuel is injected from the second fuel injection mechanism in a cold idle state, the time from fuel combustion up to ignition is increased to improve atomization. Thus, combustion can be stabilized.

Further preferably, fuel can be supplied from the high-pressure pump and low-pressure pump to the first fuel injection mechanism. The control unit effects control such that the high-pressure pump is stopped or control such that the discharge pressure from the high-pressure pump is reduced when determination is made that the operation state is in an idle state, and effects control such that fuel is injected from the first fuel injection mechanism or control such that fuel is injected from the first and second fuel injection mechanisms when in a warm idle state.

In accordance with the present invention, control is effected such that the high-pressure pump is stopped or such that the discharge pressure from the high-pressure pump is reduced when in a warm idle state. Therefore, generation of the operation noise of the high-pressure pump when the internal combustion engine is in an idling mode can be obviated.

Further, since fuel of low pressure is injected from the first fuel injection mechanism in a warm idle state, the temperature at the injection hole is reduced to obviate generation of deposits.

Further preferably, the control unit effects control such that the fuel injection ratio of the first fuel injection mechanism is increased as the temperature of the internal combustion engine becomes higher when fuel is to be injected from the first fuel injection mechanism and the second fuel injection mechanism in a warm idle state.

The possibility of deposits being generated at the injection hole of the first fuel injection mechanism is increased as the temperature of the internal combustion engine becomes higher, leading to unstable combustion. In accordance with the present invention, control is effected such that more fuel is injected from the first fuel injection mechanism as the temperature of the internal combustion engine becomes higher. Thus, generation of deposits can be obviated.

More preferably, the control unit further includes an injection control unit that effects control such that, when fuel is injected from the first fuel injection mechanism in an idle state, the smallest amount of fuel is injected from the first fuel injection mechanism and a differential amount from the required amount of injection is injected from the second fuel injection mechanism until the pressure of fuel supplied to the first fuel injection mechanism becomes less than a predetermined pressure.

In accordance with the present invention, the state of the high-pressure pump being operated and fuel of high pressure being supplied to the first fuel injection mechanism is modified such that fuel of low pressure is injected from the first fuel injection mechanism when attaining a warm idle state. At this stage, the pressure of fuel at the high-pressure fuel system is gradually reduced from the time of stopping the operation of the high-pressure pump such that the pressure of fuel becomes lower at every operation cycle of the internal combustion engine. The amount of fuel injected from the first fuel injection mechanism is set corresponding to the smallest amount of fuel until the pressure of fuel supplied to the first fuel injection mechanism becomes low enough. As a result, the amount of fuel injected will not differ between the operation cycles even when the fuel pressure at the high-pressure fuel system changes. Thus, variation in the air-fuel ratio, emission degradation, and drivability degradation can be obviated. In the case where the required amount of injection cannot be satisfied (insufficient) when the amount of fuel injected from the first fuel injection mechanism is set to the smallest amount of fuel, the power required of the internal combustion engine can be realized by injecting the insufficient amount from the second fuel injection mechanism.

Further preferably, the control unit effects control such that fuel increased in pressure by the high-pressure pump is supplied to the first fuel injection mechanism and fuel is injected from the first fuel injection mechanism when in a high temperatue idle state higher than the warm idle state by at least a predetermined temperature.

In a state where the temperature of the internal combustion engine is higher than that in a warm state, deposits are more likely to be generated at the injection hole of the first fuel injection mechanism. Therefore, high-pressure fuel is injected from the first fuel injection mechanism into the cylinder in such a state. Accordingly, deposits generated at the injection hole of the first fuel injection mechanism can be blown away by the high-pressure fuel.

According to another aspect of the present invention, a control apparatus controls an internal combustion engine including a low-pressure pump that supplies fuel of low pressure and a high-pressure pump that supplies fuel of high pressure to a fuel injection mechanism from a fuel tank. The internal combustion engine includes a first fuel injection mechanism injecting fuel into a cylinder, and a second fuel injection mechanism injecting fuel into an intake manifold. In this internal combustion engine, fuel can be supplied from the high-pressure pump and low-pressure pump to the first fuel injection mechanism. The control apparatus includes a determination unit determining that an operation state of the internal combustion engine is in an idle state, and a control unit controlling the internal combustion engine. The control unit controls the low-pressure and high-pressure pumps and the fuel injection mechanisms depending upon which of two or more predetermined idle states the idle state belongs to based on the temperature of the internal combustion engine, and effects control such that the high-pressure pump is stopped or control such that the discharge pressure from the high-pressure pump is reduced when determination is made that the operation state is in an idle state. The control unit also effects control such that fuel is injected from the second fuel injection mechanism when in a cold idle state, and effects control such that fuel is injected from the first fuel injection mechanism or control such that fuel is injected from the first and second fuel injection mechanisms when in a warm idle state.

Similarly to the above-described invention, there can be provided a control apparatus for an internal combustion engine that obviates generation of an operation noise of the high-pressure pump, maintains stable combustion, and suppresses generation of deposits at the injection hole of the fuel injection mechanism when in an idling mode of the internal combustion engine.

Further preferably, the first fuel injection mechanism is an in-cylinder injector, and the second fuel injection mechanism is an intake manifold injector.

In accordance with the present invention, there can be provided a control apparatus for an internal combustion engine that has an in-cylinder injector and an intake manifold injector qualified as the first fuel injection mechanism and the second fuel injection mechanism, respectively, provided independently, for partaking in fuel injection to obviate generation of an operation noise of the high-pressure fuel pump, maintain stable combustion, and suppress generation of deposits at the injection hole of the fuel injection mechanism in an idling mode of the internal combustion engine.

The foregoing and other objects, features, aspects and advantages of the present invention will become more apparent from the following detailed description of the present invention when taken in conjunction with the accompanying drawings.

BRIEF DESCRIPTION OF THE DRAWINGS

FIG. 6 represents the injection manner at each idle region of the engine.

FIGS. 7 and 8 are first and second injection ratio maps, respectively, directed to a warm idle region.

DESCRIPTION OF THE PREFERRED EMBODIMENTS

Figure 1:
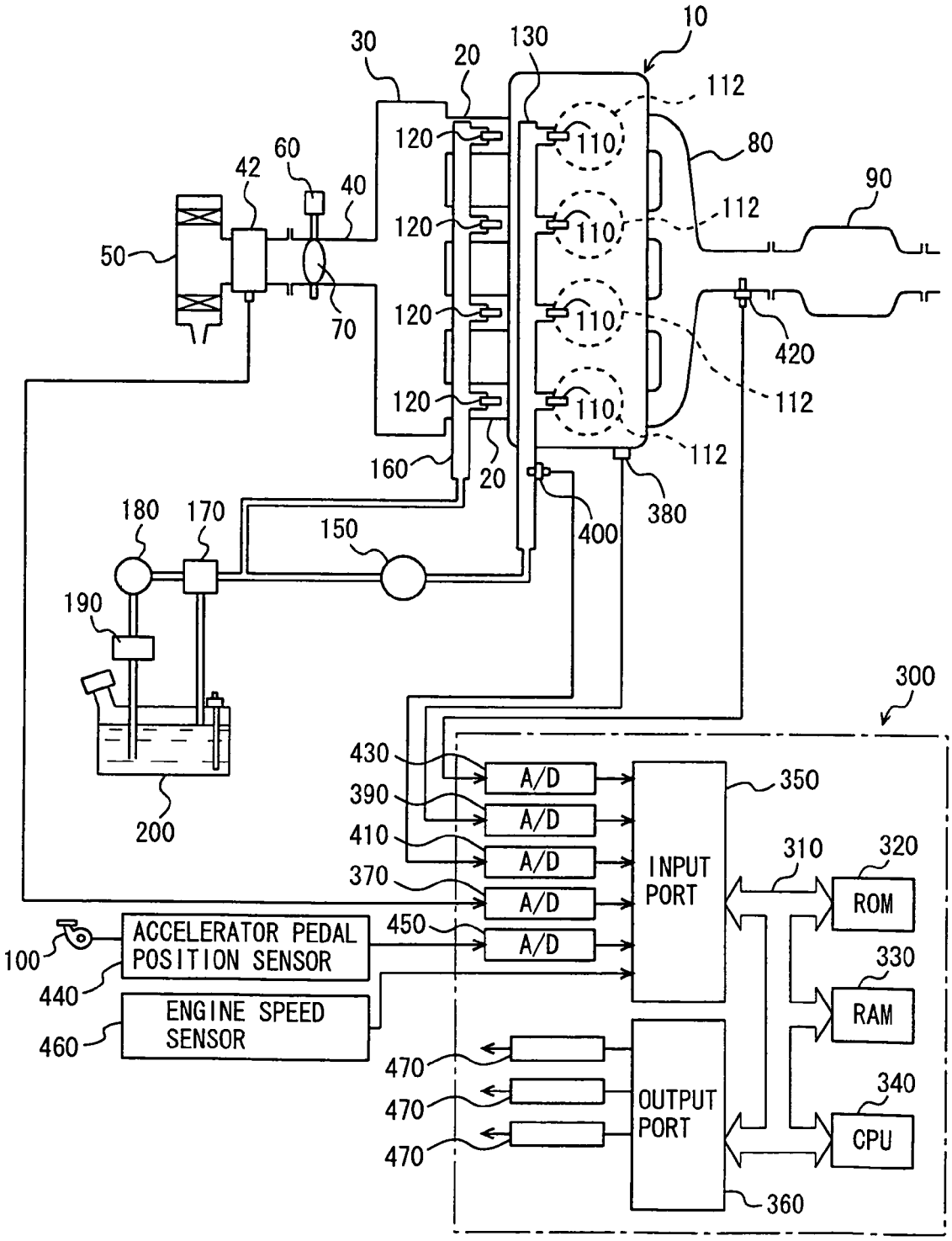
FIG. 1 is a schematic configuration diagram of an engine system under control of a control apparatus according to a first embodiment of the present invention.

Embodiments of the present invention will be described hereinafter with reference to the drawings. The same elements have the same reference characters allotted. Their designation and function are also identical. Therefore, detailed description thereof will not be repeated.

First Embodiment

FIG. 1 schematically shows a configuration of an engine system under control of an engine ECU (Electronic Control Unit) qualified as a control apparatus for an internal combustion engine according to a first embodiment of the present invention. Although an in-line 4-cylinder gasoline engine is shown in FIG. 1, application of the present invention is not limited to the engine shown, and a V-type 6-cylinder engine, a V-type 8-cylinder engine, an in-line 6-cylinder engine, and the like may be employed. The present invention is applicable as long as the engine includes an in-cylinder injector for each cylinder.

Referring to FIG. 1, an engine 10 includes four cylinders 112, which are all connected to a common surge tank 30 via intake manifolds 20, each corresponding to a cylinder 112. Surge tank 30 is connected to an air cleaner 50 via an intake duct 40. An air flow meter 42 is arranged together with a throttle valve 70 driven by an electric motor 60 in intake duct 40. Throttle valve 70 has its opening controlled based on an output signal of engine ECU 300, independent of an accelerator pedal 100. A common exhaust manifold 80 is coupled to each cylinder 112. Exhaust manifold 80 is coupled to a three-way catalytic converter 90.

There are provided for each cylinder 112 an in-cylinder injector 110 to inject fuel into a cylinder, and an intake manifold injector 120 to inject fuel towards an intake port and/or an intake manifold. Each of injectors 110 and 120 is under control based on an output signal from engine ECU 300. Each in-cylinder injector 110 is connected to a common fuel delivery pipe 130. Fuel delivery pipe 130 is connected to a high-pressure fuel pumping device 150 of an engine-drive type via a check valve that permits passage towards fuel delivery pipe 130. The present embodiment will be described based on an internal combustion engine having two injectors provided individually. It will be understood that the present invention is not limited to such an internal combustion engine. An internal combustion engine including one injector having both an in-cylinder injection function and intake manifold injection function may be employed. Further, high-pressure fuel pumping device 150 is not limited to an engine driven type, and may be a motor-driven high-pressure fuel pump.

As shown in FIG. 1, high-pressure fuel pumping device 150 has its discharge side coupled to the intake side of fuel delivery pipe 130 via an electromagnetic spill valve. This electromagnetic spill valve is configured such that the amount of fuel supplied from high-pressure fuel pumping device 150 into fuel delivery pipe 130 increases as the opening of the electromagnetic spill valve is smaller, and the supply of fuel from high-pressure fuel pumping device 150 into fuel delivery pipe 130 is stopped when the electromagnetic spill valve is completely open. The electromagnetic spill valve is under control based on an output signal from engine ECU 300. The details will be described afterwards.

Each intake manifold injector 120 is connected to a common fuel delivery pipe 160 corresponding to a low pressure side. Fuel delivery pipe 160 and high-pressure fuel pumping device 150 are connected to an electric motor driven type low-pressure fuel pump 180 via a common fuel pressure regulator 170. Low-pressure fuel pump 180 is connected to a fuel tank 200 via a fuel filter 190. Fuel pressure regulator 170 is configured such that, when the pressure of the fuel discharged from low-pressure fuel pump 180 becomes higher than a preset fuel pressure, the fuel output from low-pressure fuel pump 180 is partially returned to fuel tank 200. Thus, fuel pressure regulator 170 functions to prevent the pressure of fuel supplied to intake manifold injector 120 and the pressure of fuel supplied to high-pressure fuel pumping device 150 from becoming higher than the set fuel pressure.

Engine ECU 300 is formed of a digital computer, and includes a ROM (Read Only Memory) 320, a RAM (Random Access Memory) 330, a CPU (Central Processing Unit) 340, an input port 350, and an output port 360, connected to each other via a bidirectional bus 310.

Air flow meter 42 generates an output voltage in proportion to the intake air. The output voltage of air flow meter 42 is applied to input port 350 via an A/D converter 370. A coolant temperature sensor 380 that generates an output voltage in proportion to the engine coolant temperature is attached to engine 10. The output voltage of coolant temperature sensor 380 is applied to input port 350 via an A/D converter 390.

A fuel pressure sensor 400 that generates an output voltage in proportion to the fuel pressure in fuel delivery pipe 130 is attached to fuel delivery pipe 130. The output voltage of fuel pressure sensor 400 is applied to input port 350 via an A/D converter 410. An air-fuel ratio sensor 420 that generates an output voltage in proportion to the oxygen concentration in the exhaust gas is attached to an exhaust manifold 80 upstream of three-way catalytic converter 90. The output voltage of air-fuel ratio sensor 420 is applied to input port 350 via an A/D converter 430.

Air-fuel ratio sensor 420 in the engine system of the present embodiment is a full-range air-fuel ratio sensor (linear air-fuel ratio sensor) that generates an output voltage in proportion to the air fuel ratio of the air-fuel mixture burned in engine 10. For air-fuel ratio sensor 420, an $O_2$ sensor may be used, which detects, in an ON/OFF manner, whether the air-fuel ratio of the mixture burned in engine 10 is rich or lean with respect to the stochiometric ratio.

Accelerator pedal 100 is connected to an accelerator position sensor 440 that generates an output voltage in proportion to the press-down of accelerator pedal 100. The output voltage of accelerator position sensor 440 is applied to input port 350 via an A/D converter 450. An engine speed sensor 460 generating an output pulse representing the engine speed is connected to input port 350. ROM 320 of engine ECU 300 prestores, in the form of a map, values of fuel injection quantity that are set corresponding to operation states based on the engine load factor and engine speed obtained by accelerator position sensor 440 and engine speed sensor 460 set forth above, correction values based on the engine coolant temperature, and the like.

The fuel supply mechanism of engine 10 set forth above will be described hereinafter with reference to FIG. 2. The fuel supply mechanism includes a feed pump 1100 (equivalent to low-pressure fuel pump 180 of FIG. 1) provided at fuel tank 200 to supply fuel at a low discharge level (approximately 400 kPa that is the pressure of the pressure regulator), a high-pressure fuel pumping device 150 (high-pressure fuel pump 1200) driven by a cam 1210, a high pressure delivery pipe 1110 (equivalent to fuel delivery pipe 130 of FIG. 1) provided to supply high-pressure fuel to in-cylinder injector 110, an in-cylinder injector 110, one provided for each cylinder, at a high-pressure delivery pipe 1110, a low-pressure delivery pipe 1120 provided to supply pressure to intake manifold injector 120, and an intake manifold injector 120, one provided for the intake manifold of each cylinder, at low-pressure delivery pipe 1120.

Feed pump 1100 of fuel tank 200 has its discharge outlet connected to low-pressure supply pipe 1400, which branches into a low-pressure delivery communication pipe 1410 and a pump supply pipe 1420. Low-pressure delivery communication pipe 1410 is connected to low-pressure delivery pipe 1120 provided at intake manifold injector 120.

Pump supply pipe 1420 is connected to the entrance of high-pressure fuel pump 1200. A pulsation damper 1220 is provided at the front of the entrance of high-pressure fuel pump 1200 to dampen the fuel pulsation.

The discharge outlet of high-pressure fuel pump 1200 is connected to a high-pressure delivery communication pipe 1500, which is connected to high-pressure delivery pipe 1100. A relief valve 1140 provided at high-pressure delivery pipe 1110 is connected to a high-pressure fuel pump return pipe 1600 via a high-pressure delivery return pipe 1610. The return opening of high-pressure fuel pump 1200 is connected to high-pressure fuel pump return pipe 1600. High-pressure fuel pump return pipe 1600 is connected to a return pipe 1630, which is connected to fuel tank 200.

Figure 2:
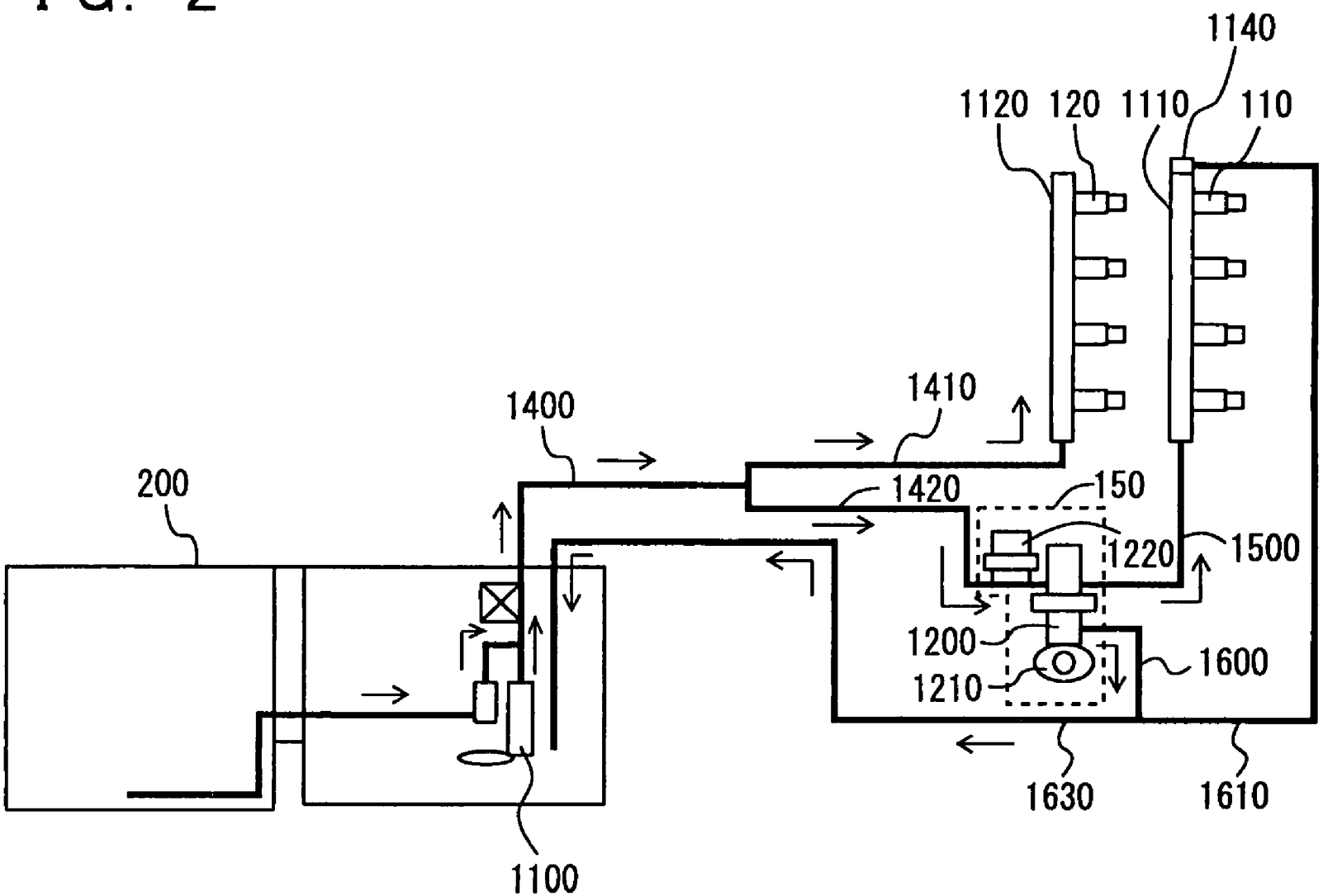
FIG. 2 shows a schematic overall view of a fuel supply mechanism of the engine system of FIG. 1.
Figure 3:
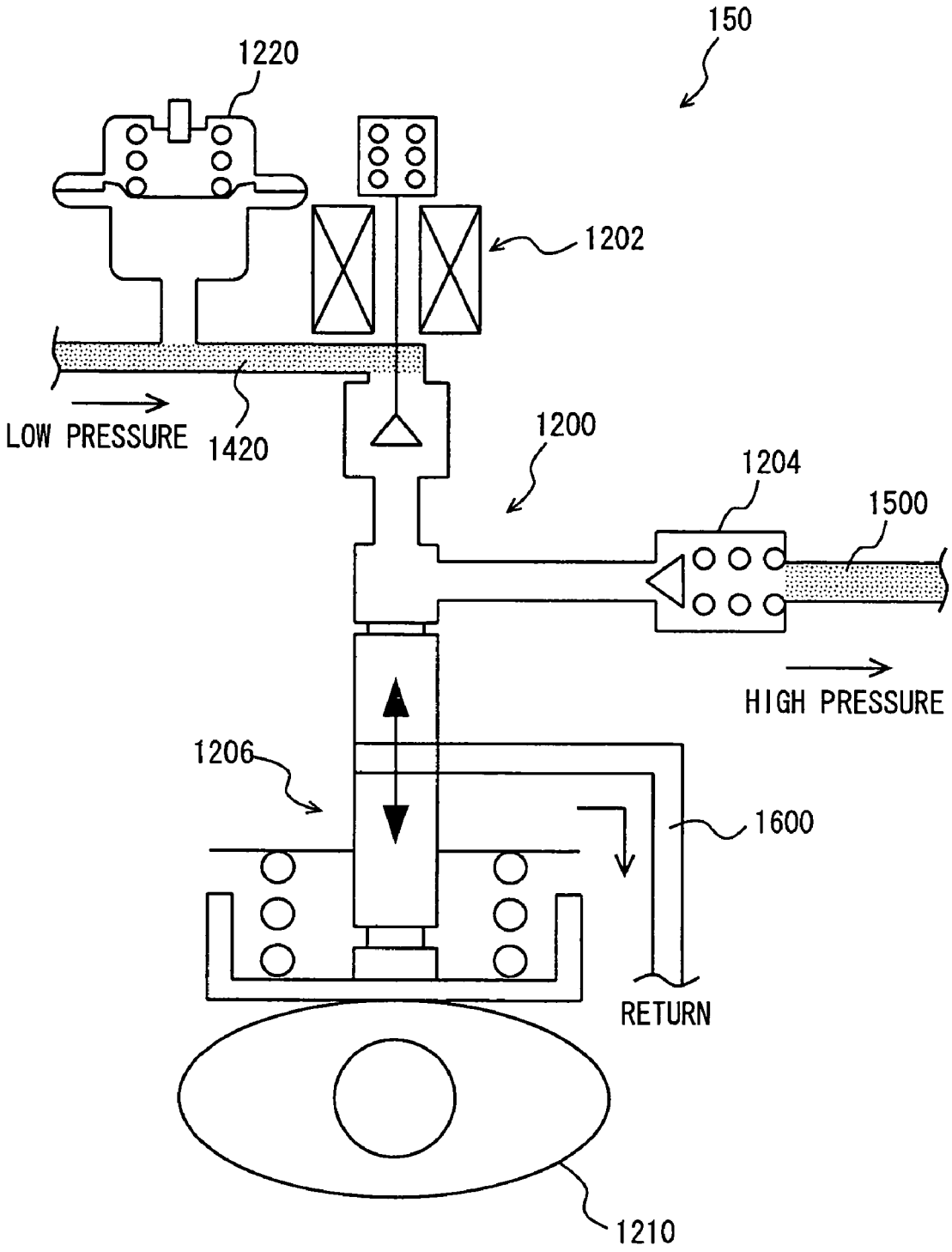
FIG. 3 is a partial enlarged view of FIG. 2.

FIG. 3 is an enlarged view of the neighborhood of high-pressure fuel pumping device 150 of FIG. 2. High-pressure fuel pumping device 150 is formed mainly of the components of high-pressure fuel pump 1200, a pump plunger 1206 driven by a cam 1210 to slide up and down, an electromagnetic spill valve 1202 and a check valve 1204 with a leak function.

When pump plunger 1206 moves downwards by cam 1210 and electromagnetic spill valve 1202 is open, fuel is introduced (drawn in). The timing of closing electromagnetic spill valve 1202 is altered when pump plunger 1206 is moving upwards by cam 1210 to control the amount of fuel discharged from high-pressure fuel pump 1200. More fuel will be discharged as the time to close electromagnetic spill valve 1202 during the pressurizing state when pump plunger 1206 is moving upwards is set earlier and less fuel will be discharged as the time to close electromagnetic spill valve 1202 is delayed. The drive duty of electromagnetic spill valve 1202 when the discharged amount is maximum is set as 100%, whereas the drive duty of electromagnetic spill valve 1202 when the minimum amount is discharged is set as 0%. In the case where the drive duty of electromagnetic spill valve 1202 is 0%, electromagnetic spill valve 1202 maintains an open state without closing. Although pump plunger 1206 moves up and down as long as cam 1210 rotates (as long as engine 10 rotates), the fuel is not pressurized since electromagnetic spill valve 1202 does not close.

The fuel under pressure will push and open check valve 1204 (set pressure approximately 60 kPa) to be pumped towards high-pressure delivery pipe 1110 via high-pressure delivery communication pipe 1500. At this stage, the fuel pressure is feedback-controlled by fuel pressure sensor 400 provided at high-pressure delivery pipe 1110.

The duty ratio DT that is the control value to control the discharged amount of fuel of high-pressure fuel pump 1200 (the time to start closing electromagnetic spill valve 1202) will be described hereinafter. Duty ratio DT varies in the range of 0 to 100%, and relates to the cam angle of cam 1210 corresponding to the closing period of electromagnetic spill valve 1202. Specifically, the duty ratio DT indicates the ratio of the target cam angle θ to the maximum cam angle θ (0), where "θ (0)" is the cam angle corresponding to the longest closing period of electromagnetic spill valve 1202 (maximum cam angle) and "θ" is the cam angle corresponding to the target value of the closing period of electromagnetic spill valve 1202 (target cam angle). Therefore, duty ratio DT approaches 100% as the target closing period of electromagnetic spill valve 1202 (the time to start closing the valve) approximates the maximum closing period, and approaches 0% as the target closing valve period approximates "0".

As duty ratio DT approximates 100%, the time to start closing electromagnetic spill valve 1202 that is adjusted based on duty ratio DT is set earlier, such that the closing period of electromagnetic spill valve 1202 becomes longer. As a result, the amount of fuel discharged from high-pressure fuel pump 1200 increases and fuel pressure P becomes higher. In contrast, as duty ratio DT approximates 0%, the time to start closing electromagnetic spill valve 1202 that is adjusted based on duty ratio DT is delayed, so that the closing period of electromagnetic spill valve 1202 becomes shorter. As a result, the amount of fuel discharged from high-pressure fuel pump 1200 is reduced and fuel pressure P becomes lower.

Figure 4:
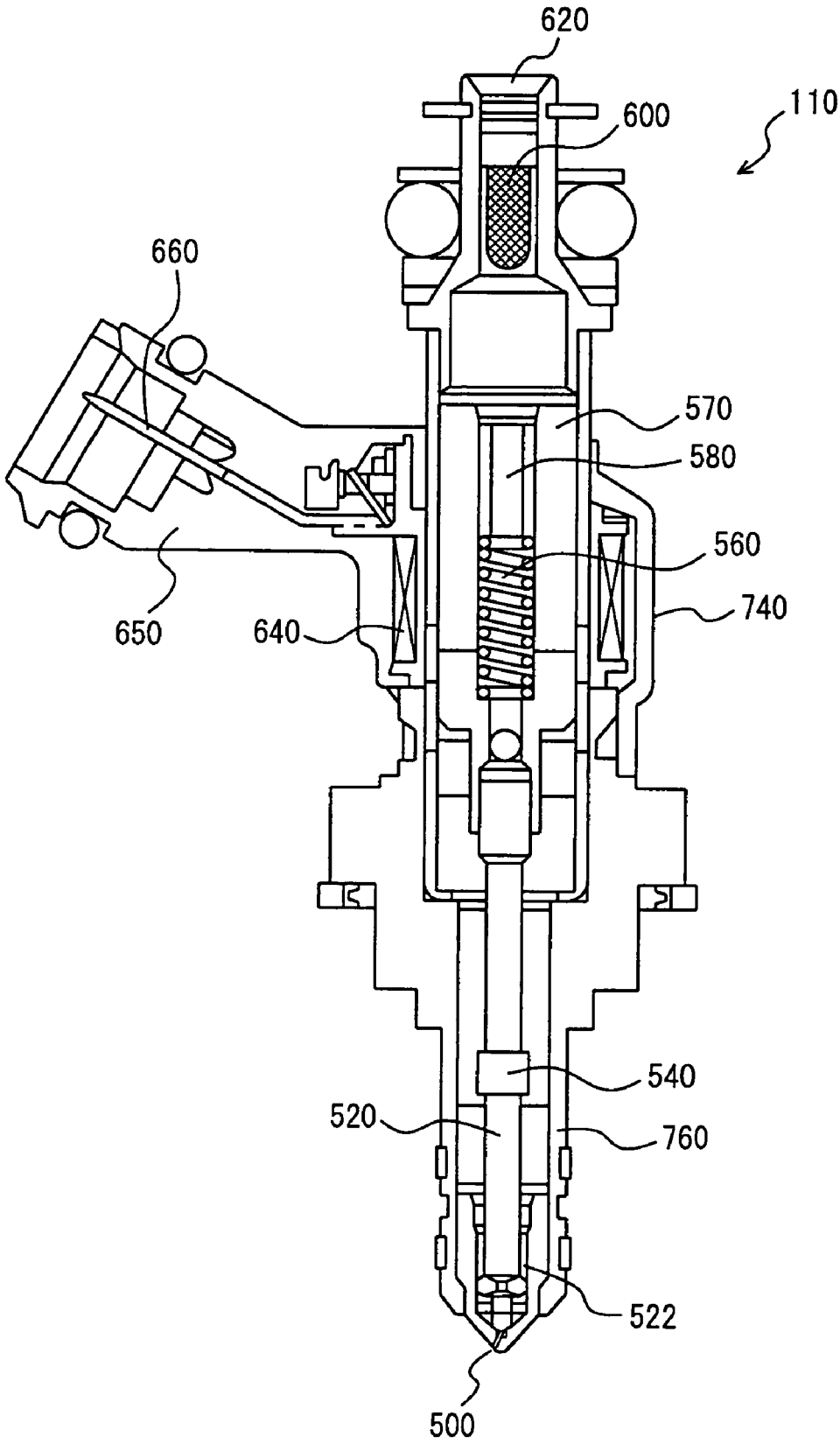
FIG. 4 is a sectional view of an in-cylinder injector.

In-cylinder injector 110 will be described hereinafter with reference to the sectional view of FIG. 4 corresponding to the vertical direction of in-cylinder injector 110.

In-cylinder injector 110 has a nozzle body 760 at a lower end of a main body 740, fixed by a nozzle holder via a spacer. Nozzle body 760 has an injection hole 500 formed at the lower end thereof. A needle 520 that can move up and down is arranged in nozzle body 760. The upper end of needle 520 abuts against a slidable core 540 in main body 740. A spring 560 urges needle 520 downswards via core 540. Needle 520 is seated at an inner circumferential seat face 522 of nozzle body 760. As a result, injection hole 500 is closed in a normal state.

A sleeve 570 is insertedly and secured at the upper end of main body 740. A fuel channel 580 is formed in sleeve 570. The lower end side of fuel channel 580 communicates with the interior of nozzle body 760 via a channel in main body 740. Fuel is injected out from injection hole 500 when needle 520 is lifted up. The upper end side of fuel channel 580 is connected to a fuel introduction opening 620 via a filter 600. Fuel introduction opening 620 is connected to fuel delivery pipe 130 of FIG. 1.

An electromagnetic solenoid 640 is arranged so as to surround the lower end portion of sleeve 570 in main body 740. When a current is applied to solenoid 640, core 540 moves upwards against spring 560, whereby the fuel pressure pushes needle 520 up and injection hole 500 is open. Thus, fuel injection is effected. Solenoid 640 is taken out to a wire 660 within an insulating housing 650, so that solenoid 640 can receive an electric signal directed to valve-opening from engine ECU 300. Fuel injection from in-cylinder injector 110 cannot be effected unless this electric signal directed to valve-opening is output from engine ECU 300.

The fuel injection time and fuel injection period of in-cylinder injector 110 are controlled by an electric signal directed to valve-opening, received from engine ECU 300. By controlling the fuel injection period, the fuel injection quantity from in-cylinder injector 110 can be adjusted. In other words, control can be effected to inject a small amount of fuel (in a region of at least the minimum fuel injection quantity) by the electric signal. It is to be noted that an EDU (Electronic Driver Unit) may be provided between engine ECU 300 and in-cylinder injector 110 for such control.

Figure 5:
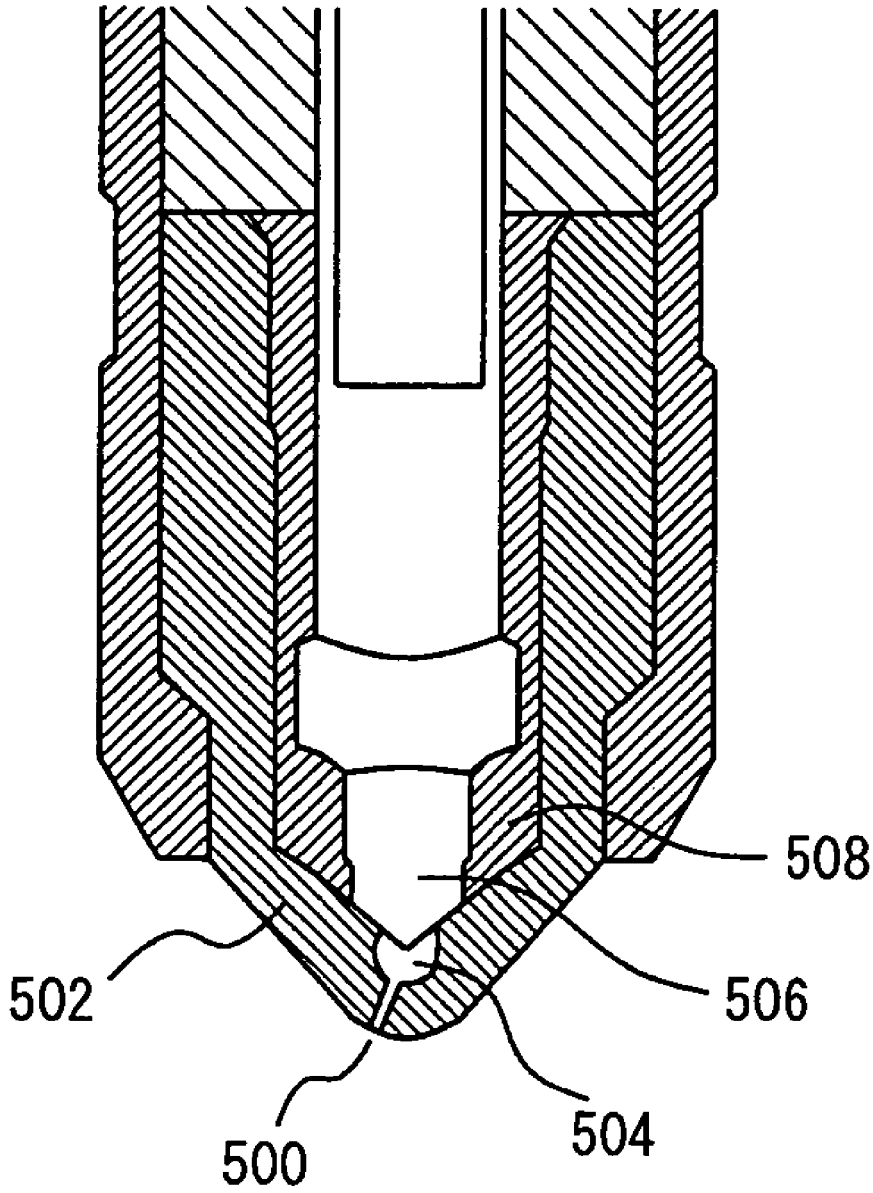
FIG. 5 is a sectional view of the leading end of an in-cylinder injector.

FIG. 5 represents a sectional view of in-cylinder injector 110 in the leading end region. A valve body 502 where injection hole 500 is provided, a suck volume 504 identified as a fuel reservoir, a needle tip 506, and a fuel reside region 508 constitute the leading end of in-cylinder injector 110.

It is considered that after fuel is injected from in-cylinder injector 110 during an intake stroke or compression stroke, a portion of fuel pushed out from fuel reside region 508 by needle tip 506 will remain in suck volume 504 without being injected outside in-cylinder injector 110 through injection hole 500. It is also considered that, if the operation of in-cylinder injector 110 is continuously ceased, fuel will leak into suck volume 504 from the sealing portion by oil tightness.

The temperature at the leading end of in-cylinder injector 110 is greatly affected by the heat from the burning gas. In view of additional factors such as heat from the head, heat radiation towards the fuel, and the like, injection hole 500 is apt to be clogged by the gradually developed carbon as the temperature becomes higher.

Since the pressure of fuel supplied to in-cylinder injector 110 having the configuration set forth above is extremely high (approximately 13 MPa), a large noise or vibration will occur at the time of opening and closing the valve. Although such a noise or vibration may not be auditory perceivable by the passenger of the vehicle on which engine 10 is mounted in the region where the load and the speed of engine 10 are high, the noise and/or vibration may be sensed by the passenger in the region where the load and speed of engine 10 are low. In this context, engine ECU 300 qualified as the control apparatus for an internal combustion engine of the present embodiment has the idle region of engine 10, when in an idle state, divided into a fast idle region after starting, cold idle region, warm idle region, and high temperature idle region to effect different control. Such control will be described hereinafter with reference to FIG. 6.

In the fast idle region after starting, fuel of high pressure (2-13 MPa) is injected into the cylinder at the compression stroke from in-cylinder injector 110, as shown in FIG. 6. Additionally, fuel is injected into the intake duct at the intake stroke from intake manifold injector 120. Accordingly, there are formed in the combustion chamber a homogenous air-fuel mixture with a lean air-fuel ratio in totality by intake manifold injector 120 and a stratified air-fuel mixture with a rich air-fuel ratio around the spark plug by in-cylinder injector 110. Further, by retarding the ignition timing of the spark plug significantly (for example, ATDC 15°) and increasing the exhaust temperature, the catalyst can be warmed up rapidly from the start.

In a cold idle region, the temperature of engine 10 is low such that the fuel atomization state is not favorable. Since the fuel injection quantity is low in an idle region, combustion stability is apt to be degraded. In such a cold idle region where combustion stability is not favorable, fuel at the feed pressure (low pressure: approximately 0.3 MPa) is injected from intake manifold injector 120 during the intake stroke. Since the period of time from fuel injection up to ignition is longer than the injection during the compression stroke by in-cylinder injector 110, the atomization state of fuel sprayed out can be improved. Thus, degradation in combustion can be obviated.

In a warm idle region, the temperature of engine 10 is high, leading to the possibility of facilitating generation of deposits at the injection hole of in-cylinder injector 110. In such a case, fuel of the feed pressure (low pressure) is injected from at least in-cylinder injector 110 into the cylinder. By injecting fuel at the feed pressure, the temperature at the injection hole of in-cylinder injector 110 can be reduced to obviate generation of deposits.

In at high temperature idle state, the temperature of engine 10 is higher than that of a warm state. The possibility of generation of deposits at the injection hole of in-cylinder injector 110 is further facilitated. Therefore, fuel of high pressure is injected from in-cylinder injector 110 into the cylinder. Accordingly, deposits generated at the injection hole of in-cylinder injector 110 can be blown away by the high-pressure fuel.

In a cold idle region and warm idle region, high-pressure fuel pump 1200 is stopped (duty ratio DT=0%), and low-pressure fuel of approximately 0.3 MPa by feed pump 1100 is supplied to in-cylinder injector 110. Accordingly, the operation noise is reduced since high-pressure fuel pump 1200 is stopped. It is to be noted that the discharge pressure from high-pressure fuel pump 1200 can be reduced (duty ratio DT≈0%) instead of stopping high-pressure fuel pump 1200 (duty ratio DT=0%).

The fuel injection ratio (partaking ratio) between in-cylinder injector 110 and intake manifold injector 120 in a cold idle region and a warm idle region will be described hereinafter with reference to FIGS. 7 and 8.

FIG. 7 represents the relationship between the engine coolant temperature indicating the temperature of engine 10 and the injection ratio when fuel is injected at the feed pressure (low pressure) from in-cylinder injector 110 alone in a warm idle state.

The setting is established so that the injection ratio of in-cylinder injector 110 is increased as the engine coolant temperature becomes higher. Although combustion stability is improved as the temperature of engine 10 becomes higher, the possibility of deposits being generated at the injection hole of in-cylinder injector 110 will become higher. Therefore, even if the injection ratio of in-cylinder injector 110 is increased as temperature of engine 10 becomes higher, the temperature of the injection hole of in-cylinder injector 110 can be reduced to obviate generation of deposits while maintaining combustion stability. As a result, favorable combustion stability and suppressing deposit generation can both be achieved.

FIG. 8 represents the relationship between the engine coolant temperature indicating the temperature of engine 10 and the injection ratio when in-cylinder injector 110 and intake manifold injector 120 partake in fuel injection at the feed pressure (low pressure) in a warm idle state.

Although the setting is established such that the injection ratio of in-cylinder injector 110 is increased as the engine coolant temperature becomes higher, fuel is also injected from intake manifold injector 120 in the warm idle region, differing from the operation of FIG. 7. Accordingly, a homogenous air-fuel mixture can be obtained by the fuel injected from intake manifold injector 120 to further improve combustion stability. Since the injection ratio of in-cylinder injector 110 is increased as the temperature of engine 10 becomes higher, the temperature at the injection hole of in-cylinder injector 110 can be reduced to obviate generation of deposits. As a result, favorable combustion stability and preventing generation of deposits can both be achieved.

Figure 9:
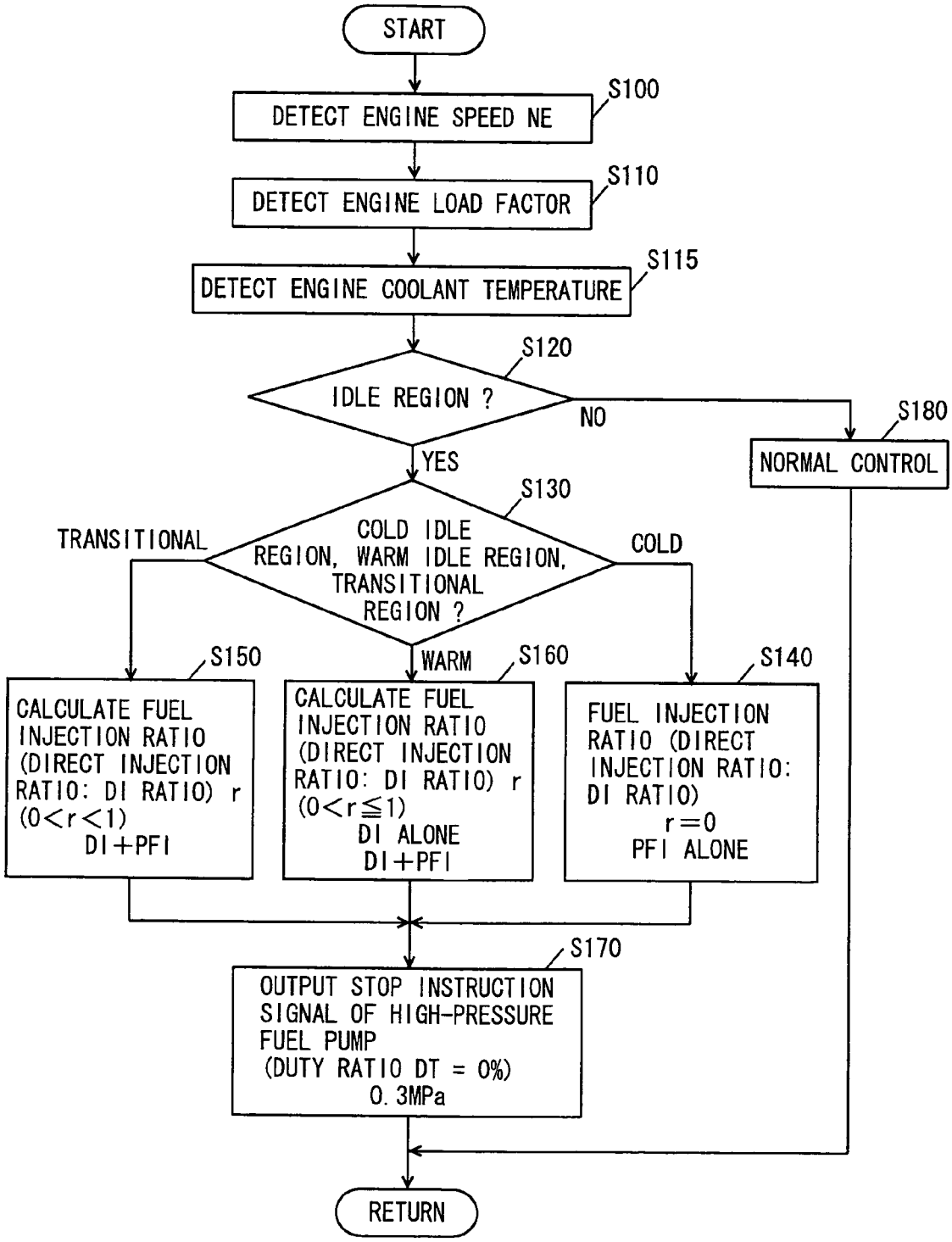
FIGS. 9 and 10 are flow charts of a control program executed by an engine ECU qualified as a control apparatus according to first and second embodiments, respectively, of the present invention.

A control program executed by engine ECU 300 qualified as the control apparatus of the present embodiment will be described hereinafter with reference to FIG. 9. The program of FIG. 9 is based on the assumption that the operation region of engine 10 is in any of the cold idle region, the warm idle region, or the transitional region from the cold idle region to the warm idle region shown in FIG. 7 or FIG. 8. The flow chart of FIG. 9 is repeatedly executed in a predetermined time cycle (for example, 100 ms). It is to be noted that the aforementioned transitional region may be included in the warm region.

At step (hereinafter, step abbreviated as "S") 100, engine ECU 300 detects engine speed NE based on a signal from speed sensor 460 of engine 10. At S110, engine ECU 300 detects the load factor of engine 10 based on a signal from accelerator position sensor 440. The load factor of engine 10 does not necessarily have to be determined based on the pedal position of accelerator pedal 10 alone.

At S115, engine ECU 300 detects the engine coolant temperature representing the temperature of engine 10 based on a signal from coolant temperature sensor 380. The temperature of engine 10 is not limited to that represented by the temperature of the engine coolant.

At S120, engine ECU 300 determines whether the current operation region of engine 10 is in an idle region or not based on the detected engine speed NE, load factor, predetermined map, and the like. When determination is made that the current operation region of engine 10 is in an idle region (YES at S120), control proceeds to S130; otherwise (NO at S120), control proceeds to S180.

At S130, engine ECU 300 determines whether the current operation region of engine 10 is in a cold idle region or a warm idle region, or the transitional region from the cold idle region to the warm idle region. This determination is made based on the maps of either FIG. 7 or FIG. 8. When determination is made that the operation region is in a cold idle region (cold at S130), control proceeds to S140. When determination is made that the operation region is in a transitional region (transition at S130), control proceeds to S150. When determination is made that the operation region is in a warm idle region (warm at S130), control proceeds to S160.

At S140, engine ECU 300 has fuel injected from only intake manifold injector 120 with the fuel injection ratio between in-cylinder injector 110 and intake manifold injector 120 (hereinafter, indicated as direct injection ratio (DI ratio) r) set to 0. Then, control proceeds to S170.

At S150, engine ECU 300 has fuel injected from in-cylinder injector 110 and intake manifold injector 120 with the injection ratio DI that is the injection ratio between in-cylinder injector 110 and intake manifold injector 120 set to $0<r<1$. Then, control proceeds to S170.

At S160, engine ECU 300 has fuel injected from in-cylinder injector 110 alone with DI ratio r set to 1. This corresponds to FIG. 7. At this stage, engine ECU 300 may have fuel injected from in-cylinder injector 110 and intake manifold injector 120 with DI ratio r set to $0<r<1$ (provided that $r>0.5$). This corresponds to FIG. 8. Then, control proceeds to S170.

At S170, engine ECU 300 outputs a stop instruction signal of high-pressure fuel pump 1200. Specifically, a control signal corresponding to a duty ratio DT of 0% of electromagnetic spill valve 1202 is output. Accordingly, fuel pressurized to approximately 0.3 MPa by feed pump 1100 is delivered to in-cylinder injector 110.

At S180, engine ECU 300 executes control of a normal operation region other than an idle region.

The operation of engine 10 under control of engine ECU 300 qualified as the control apparatus of the present embodiment will be described hereinafter based on the configuration and flow chart set forth above.

When engine speed NE, engine load factor, and engine coolant temperature are detected (S100, S110, and S115), and the current operation region of engine 10 is in an idle region (YES at S120), determination is made whether the current operation region is in a cold idle region, a warm idle region, or a transitional region from a cold idle state to a warm idle state (S130).

When the operation region is in the cold idle region shown in FIG. 7 or FIG. 8 (cold at S130), the setting is established such that fuel is injected from intake manifold injector 120 alone (S140). When the operation region is in a warm idle region (warm at S130), the setting is established such that fuel is injected from in-cylinder injector 110 and intake manifold injector 120 (S160).

When the current operation region is in the transitional region (transition at S130), setting is established such that fuel is injected from in-cylinder injector 110 and intake manifold injector 120 ($0<r<1$) (S150).

A stop instruction signal (duty ratio DT=0%) of high-pressure fuel pump 1200 is output (S170), whereby the operation of high-pressure fuel pump 120 is stopped. At this stage, low-pressure fuel pressurized to approximately 0.3 MPa by feed pump 1100 is supplied to in-cylinder injector 110. It is to be noted that the fuel discharge pressure from high-pressure fuel pump 1200 can be reduced instead of stopping the operation of high-pressure fuel pump 1200.

Thus, the operation noise of high-pressure fuel pump 1200 is reduced since high-pressure fuel pump 1200 is stopped or the discharge pressure thereof is reduced in a cold idle region, a warm idle region, and a transitional region thereof.

Even in the case where the operation region of the engine is in an idle region, the drive and suspension of the high-pressure fuel pump are controlled, together with the injection ratio between the in-cylinder injector and the intake manifold injector, based on the division of at least a cold idle region and a warm idle region. In a cold idle region where combustion stability is given priority than suppressing generation of deposits, fuel is injected from the intake manifold injector alone to realize combustion stability. In a warm idle region where the problem of combustion stability is less likely to occur and suppressing generation of deposits at the injection hole of the in-cylinder injector is given priority, the operation of the high-pressure fuel pump is stopped to allow fuel pressurized by the feed pump to be injected from the in-cylinder injector into the cylinder (or, injected also from the intake manifold injector). Thus, the operation noise can be reduced and generation of deposits at the injection hole of the in-cylinder injector can be obviated.

Second Embodiment

An engine system under control of an engine ECU 300 qualified as a control apparatus for an internal combustion engine according to a second embodiment of the present invention will be described hereinafter. Engine ECU 300 of the second embodiment executes a program that differs partially from the program of the above-described first embodiment. The remaining hardware configuration (FIGS. 1-8) is similar to that of the first embodiment. Therefore, details thereof will not be repeated here.

Engine ECU 300 of the second embodiment executes effective control when switched from the state of high-pressure fuel pump 1200 being operated to supply high-pressure fuel from in-cylinder injector 110 to the state of injecting fuel of low pressure from in-cylinder injector 110 in a transitional idle region or warm idle region.

Figure 10:
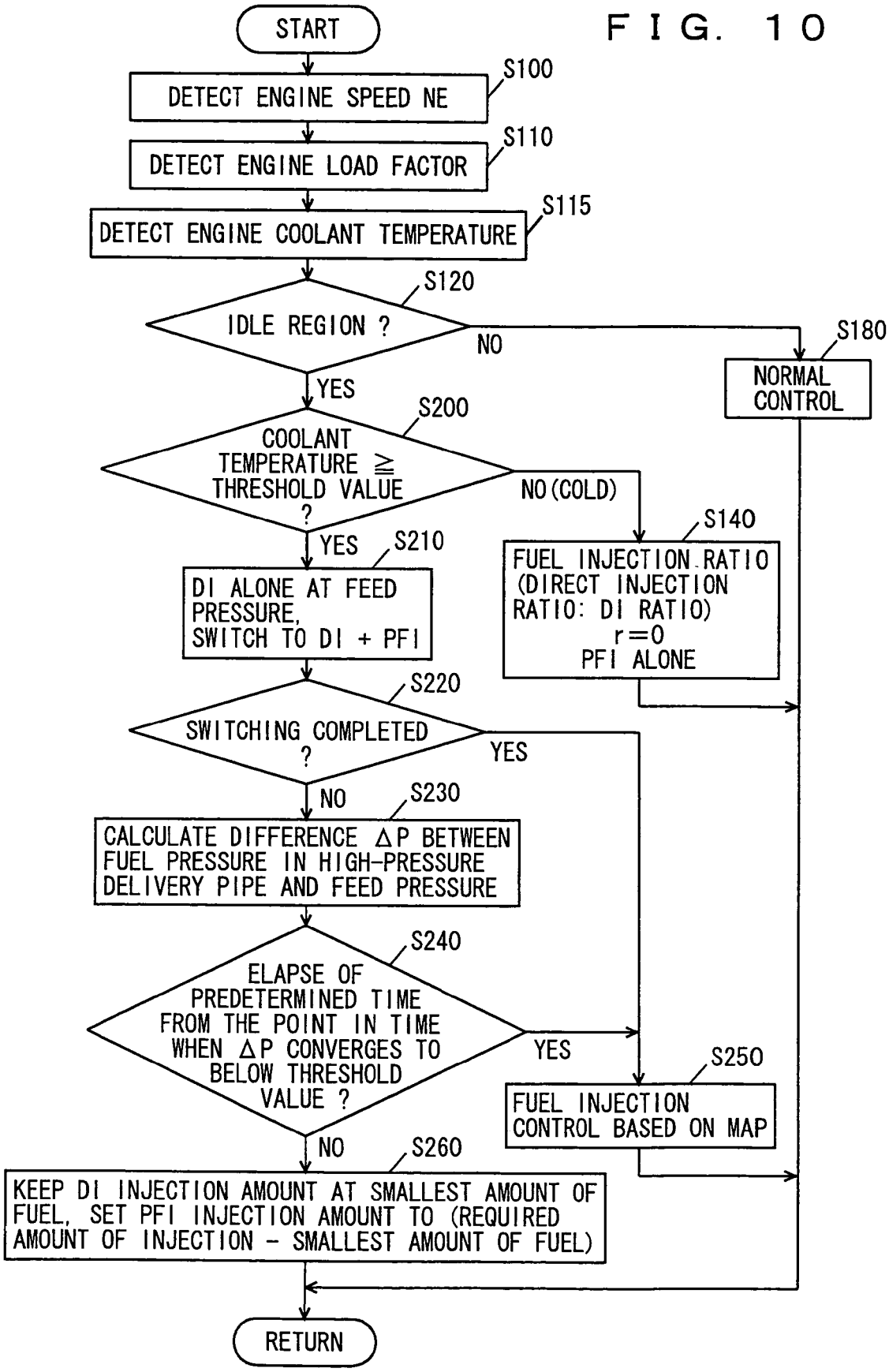

A control program executed by engine ECU 300 of the second embodiment will be described hereinafter with reference to the flow chart of FIG. 10. In the flow chart of FIG. 10, steps similar to those in FIG. 9 have the same step number allotted. Their contents are also identical. Therefore, detailed description thereof will not be repeated here. The flow chart of FIG. 10 is repeatedly executed at a predetermined time cycle (for example, 100 ms).

At S200, engine ECU 300 determines whether the engine coolant temperature is at least a predetermined threshold value (for example, 60° C. as shown in FIG. 7 or 8). When the engine coolant temperature is at least the predetermined threshold value (YES at S200), control proceeds to S210; otherwise (NO at S200), control proceeds to S140.

At S210, engine ECU 300 establishes the setting so as to switch to fuel injection by in-cylinder injector 110 alone at the feed pressure, or by in-cylinder injector 110 and intake manifold injector 120 at the feed pressure.

At S220, engine ECU 300 determines whether the switching of S210 has been completed or not. This determination is made based on whether the pressure of fuel in, for example, high-pressure delivery pipe 1110 has become as low as approximately the feed pressure. When switching is completed (YES at S220), control proceeds to S250; otherwise (NO at S250), control proceeds to S230.

At S230, engine ECU 300 obtains a pressure difference ΔP that is the difference between the pressure of fuel in high-pressure delivery pipe 1110 detected by pressure sensor 400 (fuel pressure) and the feed pressure.

At S240, engine ECU 300 determines whether a predetermined time has elapsed or not from the point in time when pressure difference ΔP obtained at S230 has converged to become lower than a predetermined threshold value. At an elapse of a predetermined time from the point of time when pressure difference ΔP has converged to become lower than a predetermined threshold value (YES at S240), control proceeds to S250; otherwise (NO at S240), control proceeds to S260.

At S250, engine ECU 300 executes fuel injection control based on a map (for example, the map shown in FIG. 7 or FIG. 8). At this stage, the pressure of fuel supplied to in-cylinder injector 110 has become as low as the feed pressure.

At S260, engine ECU 300 keeps the amount of fuel injected from in-cylinder injector 110 fixed at the smallest amount that is determined for each type of in-cylinder injector 110, and sets the amount of fuel injected from intake manifold injector 120 as the differential amount corresponding to subtracting the smallest amount of fuel injection from in-cylinder injector 110 from the required amount of injection.

The operation of engine 10 under control of an engine ECU qualified as the control apparatus of the second embodiment will be described hereinafter based on the configuration and flow chart set forth above. It is assumed that the pressure of fuel supplied to in-cylinder injector 110 from high-pressure fuel pump 1200 is increased to approximately 13 MPa.

When engine speed NE, engine load factor, and engine coolant temperature are detected (S100, S110, and S115), the current operation state of engine 10 is in an idle region (YES at S120), and the coolant temperature of engine 10 is at least a predetermined threshold value (YES at S200), switching is effected between the fuel injection at the feed pressure from in-cylinder injector 110 alone, and the partaking injection (fuel injection by in-cylinder injector 110 and intake manifold injector 120) at the feed pressure (S210).

Until this switching is completed (NO at S220), fuel injection control based on the map is not effected (S250). In other words, even if a control signal corresponding to duty ratio DT of 0% for electromagnetic spill valve 1202, identified as the stop instruction signal of high-pressure fuel pump 1200, is output, the discharge pressure from high-pressure fuel pump 1200 will not be reduced immediately, so that the pressure of fuel in high-pressure delivery pipe 1110 will also not fall immediately. Therefore, the pressure of fuel in high-pressure delivery pipe 1110 maintains a high level for a while. During this period, high-pressure fuel is supplied to in-cylinder injector 110. This gradual reduction in pressure of fuel supplied to in-cylinder injector 110 will cause different fuel injection quantity between cycles even if the fuel injection time is constant. As a result, the air-fuel ratio (A/F) will vary between cycles to induce degradation in emission and drivability.

To avoid such degradation, the pressure difference ΔP between the pressure of fuel in high-pressure delivery pipe 1110 and the feed pressure is obtained (S230) until switching is completed (NO at S220). Before the elapse of a predetermined time from the point of time when pressure difference ΔP converges to become smaller than a predetermined threshold value (NO at S240), the amount of fuel injected from in-cylinder injector 110 is kept at the level of the smallest amount for in-cylinder injector 110 (determined based on inherent properties of in-cylinder injector 110, and is the minimum amount of injection where linearity is established between the valve-opening time of in-cylinder injector 110 and the fuel injection quantity). Therefore, the air-fuel ratio will not vary even if the pressure of fuel supplied to in-cylinder injector 110 varies for each cycle since the amount of fuel injected from in-cylinder injector 110 is fixed at the minimum level. It is to be noted that the required amount of injection may not be satisfied since the amount of injection of in-cylinder injector 110 is kept at the level of the smallest amount. Therefore, the insufficient amount (=required amount of injection−smallest amount of injection) is injected from intake manifold injector 120 to realize the power required by engine 10.

Thus, when the engine operation region is in an idle region and the state is modified from the state of injecting fuel at high pressure from the in-cylinder injector to the state of injecting fuel at the feed pressure, the amount of fuel injected by the in-cylinder injector is fixed at the smallest amount until the pressure of fuel in the high-pressure delivery pipe settles in the proximity of the feed pressure. Since variation in the air-fuel ratio is suppressed even when the pressure of fuel supplied to the in-cylinder injector is reduced for every cycle, degradation in emission and drivability is prevented. Further, since the high pressure fuel pump is stopped and fuel pressurized by the feed pump is injected into the cylinder from the in-cylinder injector (or injected also from the intake manifold injector), the operation noise caused by the high-pressure fuel system when in an idle region can be reduced.

In the first and second embodiments set forth above, the operation noise is reduced by suspension of high-pressure fuel pump 1200 (duty ratio DT 0%). The operation noise can be reduced in another manner as set forth below. Since the operation noise of high-pressure fuel pump 1200 is generated reflecting the closing of electromagnetic spill valve 1202, the operation noise of high-pressure fuel pump 1200 can be reduced by lowering the closing frequency of electromagnetic spill valve 1202 (reduce the number of times of closing the valve). In this case, the discharge pressure from high-pressure fuel pump 1200 is lower than that of a normal state.

<Engine (1) to which Present Control Apparatus can be Suitably Applied>

An engine (1) to which the control apparatus of the present embodiment is suitably adapted will be described hereinafter.

Figure 11:
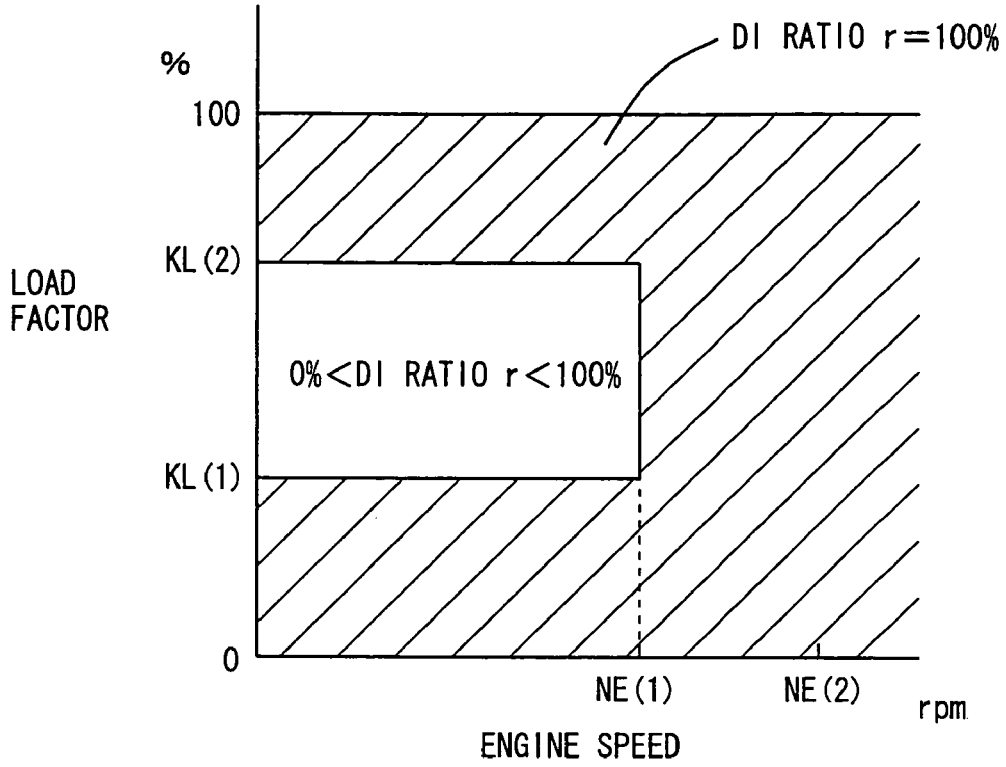
FIGS. 11 and 12 are first DI ratio maps corresponding to a warm state and a cold state, respectively, of an engine to which the control apparatus of an embodiment of the present invention is suitably adapted.
Figure 12:
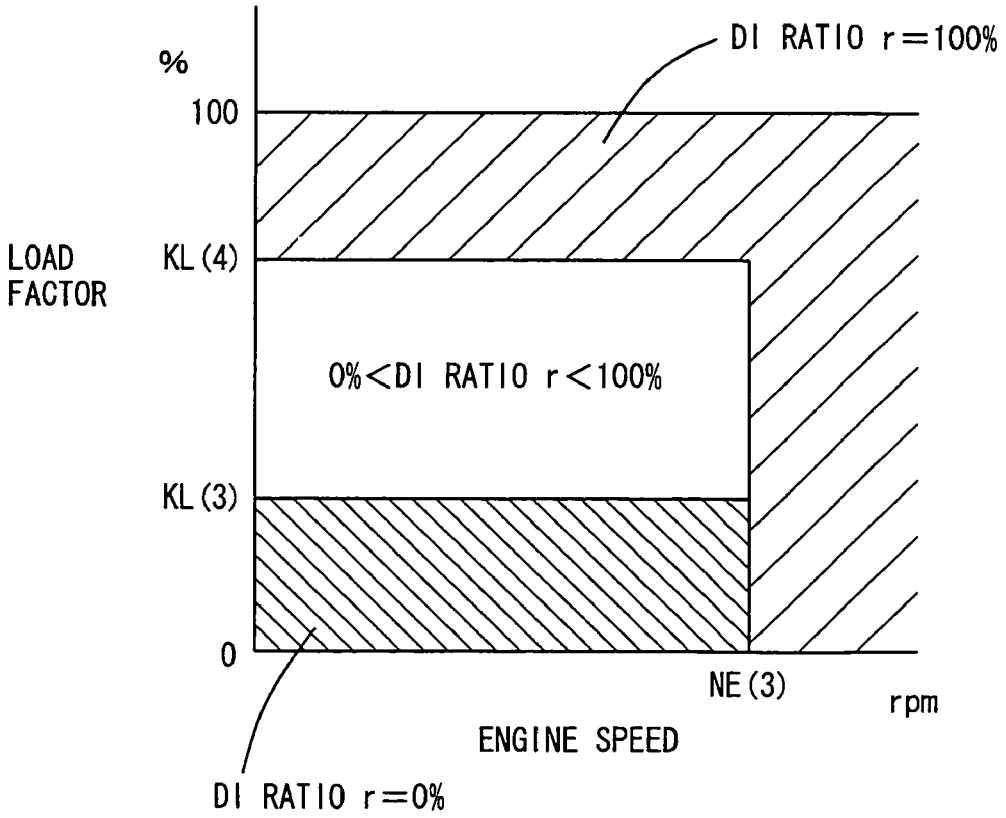

Referring to FIGS. 11 and 12, maps indicating a fuel injection ratio (hereinafter, also referred to as DI ratio (r)) between in-cylinder injector 110 and intake manifold injector 120, identified as information associated with an operation state of engine 10, will now be described. The maps are stored in an ROM 320 of an engine ECU 300.

FIG. 11 is the map for a warm state of engine 10, and FIG. 12 is the map for a cold state of engine 10.

In the maps of FIGS. 11 and 12, the fuel injection ratio of in-cylinder injector 110 is expressed in percentage as the DI ratio r, wherein the engine speed of engine 10 is plotted along the horizontal axis and the load factor is plotted along the vertical axis.

As shown in FIGS. 11 and 12, the DI ratio r is set for each operation region that is determined by the engine speed and the load factor of engine 10. "DI RATIO r=100%" represents the region where fuel injection is carried out from in-cylinder injector 110 alone, and "DI RATIO r=0%" represents the region where fuel injection is carried out from intake manifold injector 120 alone. "DI RATIO r≠0%", "DI RATIO r≠100%" and "0%<DI RATIO r<100%" each represent the region where in-cylinder injector 110 and intake manifold injector 120 partake in fuel injection. Generally, in-cylinder injector 110 contributes to an increase of power performance, whereas intake manifold injector 120 contributes to uniformity of the air-fuel mixture. These two types of injectors having different characteristics are appropriately selected depending on the engine speed and the load factor of engine 10, so that only homogeneous combustion is conducted in the normal operation state of engine 10 (for example, a catalyst warm-up state during idling is one example of an abnormal operation state).

Further, as shown in FIGS. 11 and 12, the DI ratio r of in-cylinder injector 110 and intake manifold injector 120 is defined individually in the maps for the warm state and the cold state of the engine. The maps are configured to indicate different control regions of in-cylinder injector 110 and intake manifold injector 120 as the temperature of engine 10 changes. When the temperature of engine 10 detected is equal to or higher than a predetermined temperature threshold value, the map for the warm state shown in FIG. 11 is selected; otherwise, the map for the cold state shown in FIG. 12 is selected. In-cylinder injector 110 and/or intake manifold injector 120 are controlled based on the engine speed and the load factor of engine 10 in accordance with the selected map.

The engine speed and the load factor of engine 10 set in FIGS. 11 and 12 will now be described. In FIG. 11, NE(1) is set to 2500 rpm to 2700 rpm, KL(1) is set to 30% to 50%, and KL(2) is set to 60% to 90%. In FIG. 12, NE(3) is set to 2900 rpm to 3100 rpm. That is, NE(1)<NE(3). NE(2) in FIG. 11 as well as KL(3) and KL(4) in FIG. 12 are also set appropriately.

In comparison between FIG. 11 and FIG. 12, NE(3) of the map for the cold state shown in FIG. 12 is greater than NE(1) of the map for the warm state shown in FIG. 11. This shows that, as the temperature of engine 10 becomes lower, the control region of intake manifold injector 120 is expanded to include the region of higher engine speed. That is, in the case where engine 10 is cold, deposits are unlikely to accumulate in the injection hole of in-cylinder injector 110 (even if fuel is not injected from in-cylinder injector 110). Thus, the region where fuel injection is to be carried out using intake manifold injector 120 can be expanded, whereby homogeneity is improved.

In comparison between FIG. 11 and FIG. 12, "DI RATIO r=100%" in the region where the engine speed of engine 10 is NE(1) or higher in the map for the warm state, and in the region where the engine speed is NE(3) or higher in the map for the cold state. In terms of load factor, "DI RATIO r=100%" in the region where the load factor is KL(2) or greater in the map for the warm state, and in the region where the load factor is KL(4) or greater in the map for the cold state. This means that in-cylinder injector 110 alone is used in the region of a predetermined high engine speed, and in the region of a predetermined high engine load. That is, in the high speed region or the high load region, even if fuel injection is carried out through in-cylinder injector 110 alone, the engine speed and the load of engine 10 are so high and the intake air quantity so sufficient that it is readily possible to obtain a homogeneous air-fuel mixture using only in-cylinder injector 110. In this manner, the fuel injected from in-cylinder injector 110 is atomized in the combustion chamber involving latent heat of vaporization (or, absorbing heat from the combustion chamber). Thus, the temperature of the air-fuel mixture is decreased at the compression end, so that the anti-knocking performance is improved. Further, since the temperature in the combustion chamber is decreased, intake efficiency is improved, leading to high power.

In the map for the warm state in FIG. 11, fuel injection is also carried out using in-cylinder injector 110 alone when the load factor is KL(1) or less. This shows that in-cylinder injector 110 alone is used in a predetermined low-load region when the temperature of engine 10 is high. When engine 10 is in the warm state, deposits are likely to accumulate in the injection hole of in-cylinder injector 110. However, when fuel injection is carried out using in-cylinder injector 110, the temperature of the injection hole can be lowered, in which case accumulation of deposits is prevented. Further, clogging at in-cylinder injector 110 may be prevented while ensuring the minimum fuel injection quantity thereof. Thus, in-cylinder injector 110 solely is used in the relevant region.

In comparison between FIG. 11 and FIG. 12, the region of "DI RATIO r=0%" is present only in the map for the cold state of FIG. 12. This shows that fuel injection is carried out through intake manifold injector 120 alone in a predetermined low-load region (KL(3) or less) when the temperature of engine 10 is low. When engine 10 is cold and low in load and the intake air quantity is small, the fuel is less susceptible to atomization. In such a region, it is difficult to ensure favorable combustion with the fuel injection from in-cylinder injector 110. Further, particularly in the low-load and low-speed region, high power using in-cylinder injector 110 is unnecessary. Accordingly, fuel injection is carried out through intake manifold injector 120 alone, without using in-cylinder injector 110, in the relevant region.

Further, in an operation other than the normal operation, or, in the catalyst warm-up state during idling of engine 10 (an abnormal operation state), in-cylinder injector 110 is controlled such that stratified charge combustion is effected. By causing the stratified charge combustion only during the catalyst warm-up operation, warming up of the catalyst is promoted to improve exhaust emission.

<Engine (2) to Which Present Control Apparatus is Suitably Adapted>

An engine (2) to which the control apparatus of the present embodiment is suitably adapted will be described hereinafter. In the following description of the engine (2), the configurations similar to those of the engine (1) will not be repeated.

Figure 13:
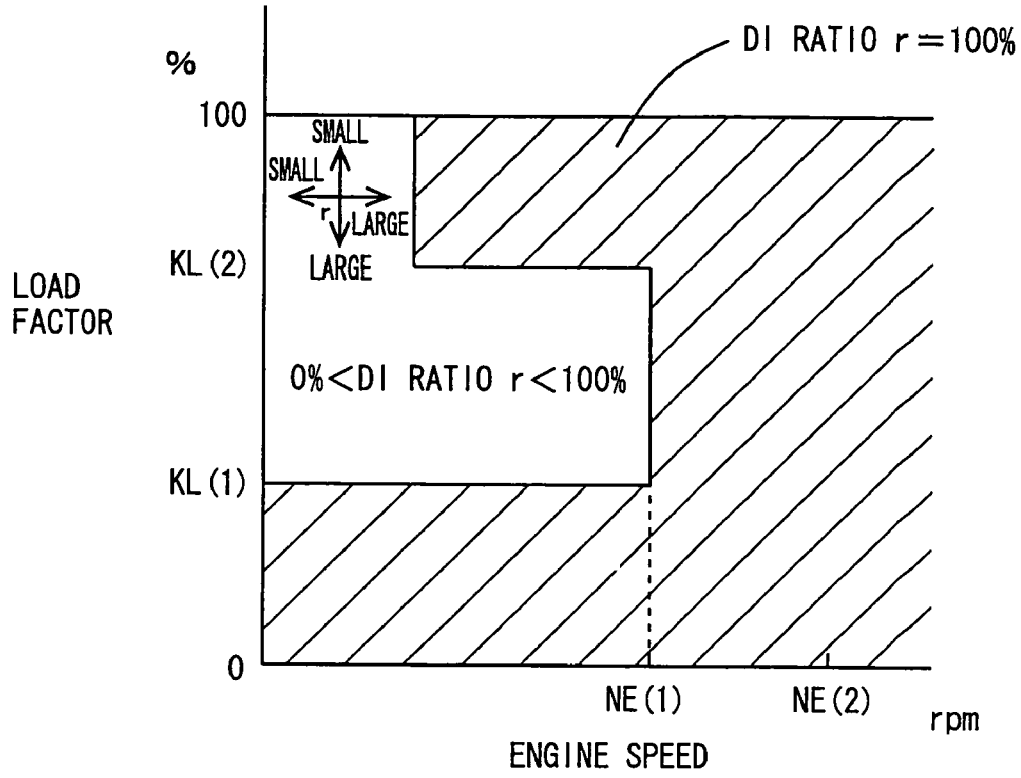
FIGS. 13 and 14 are second DI ratio maps corresponding to a warm state and a cold state, respectively, of an engine to which the control apparatus of an embodiment of the present invention is suitably adapted.
Figure 14:
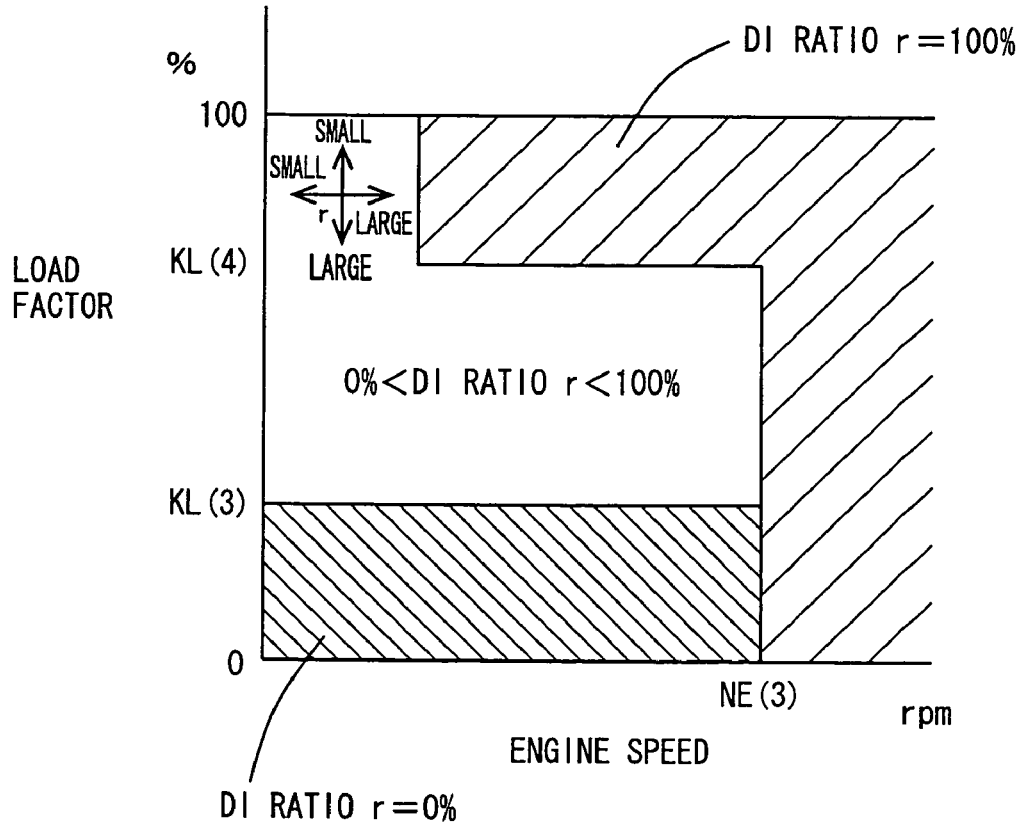

Referring to FIGS. 13 and 14, maps indicating the fuel injection ratio between in-cylinder injector 110 and intake manifold injector 120, identified as information associated with the operation state of engine 10, will be described. The maps are stored in ROM 320 of an engine ECU 300. FIG. 13 is the map for the warm state of engine 10, and FIG. 14 is the map for the cold state of engine 10.

FIGS. 13 and 14 differ from FIGS. 11 and 12 in the following points. "DI RATIO r=100%" holds in the region where the engine speed of engine 10 is equal to or higher than NE(1) in the map for the warm state, and in the region where the engine speed is NE(3) or higher in the map for the cold state. Further, "DI RATIO r=100%" holds in the region, excluding the low-speed region, where the load factor is KL(2) or greater in the map for the warm state, and in the region, excluding the low-speed region, where the load factor is KL(4) or greater in the map for the cold state. This means that fuel injection is carried out through in-cylinder injector 110 alone in the region where the engine speed is at a predetermined high level, and that fuel injection is often carried out through in-cylinder injector 110 alone in the region where the engine load is at a predetermined high level. However, in the low-speed and high-load region, mixing of an air-fuel mixture produced by the fuel injected from in-cylinder injector 110 is poor, and such inhomogeneous air-fuel mixture within the combustion chamber may lead to unstable combustion. Thus, the fuel injection ratio of in-cylinder injector 110 is to be increased as the engine speed increases where such a problem is unlikely to occur, whereas the fuel injection ratio of in-cylinder injector 110 is to be decreased as the engine load increases where such a problem is likely to occur. These changes in the DI ratio r are shown by crisscross arrows in FIGS. 13 and 14. In this manner, variation in output torque of the engine attributable to the unstable combustion can be suppressed. It is noted that these measures are substantially equivalent to the measures to decrease the fuel injection ratio of in-cylinder injector 110 in connection with the state of the engine moving towards the predetermined low speed region, or to increase the fuel injection ratio of in-cylinder injector 110 in connection with the engine state moving towards the predetermined low load region. Further, in a region other than the region set forth above (indicated by the crisscross arrows in FIGS. 13 and 14) and where fuel injection is carried out using only in-cylinder injector 110 (on the high speed side and on the low load side), the air-fuel mixture can be readily set homogeneous even when the fuel injection is carried out using only in-cylinder injector 110. In this case, the fuel injected from in-cylinder injector 110 is atomized in the combustion chamber involving latent heat of vaporization (by absorbing heat from the combustion chamber). Accordingly, the temperature of the air-fuel mixture is decreased at the compression end, whereby the antiknock performance is improved. Further, with the decreased temperature of the combustion chamber, intake efficiency is improved, leading to high power output.

In engine 10 described in conjunction with FIGS. 11-14, homogeneous combustion is realized by setting the fuel injection timing of in-cylinder injector 110 in the intake stroke, while stratified charge combustion is realized by setting it in the compression stroke. That is, when the fuel injection timing of in-cylinder injector 110 is set in the compression stroke, a rich air-fuel mixture can be located locally around the spark plug, so that a lean air-fuel mixture in totality is ignited in the combustion chamber to realize the stratified charge combustion. Even if the fuel injection timing of in-cylinder injector 110 is set in the intake stroke, stratified charge combustion can be realized if a rich air-fuel mixture can be located locally around the spark plug.

As used herein, the stratified charge combustion includes both the stratified charge combustion and semi-stratified charge combustion set forth below. In the semi-stratified charge combustion, intake manifold injector 120 injects fuel in the intake stroke to generate a lean and homogeneous air-fuel mixture in totality in the combustion chamber, and then in-cylinder injector 110 injects fuel in the compression stroke to generate a rich air-fuel mixture around the spark plug, so as to improve the combustion state. Such a semi-stratified charge combustion is preferable in the catalyst warm-up operation for the following reasons. In the catalyst warm-up operation, it is necessary to considerably retard the ignition timing and maintain a favorable combustion state (idle state) so as to cause a high-temperature combustion gas to arrive at the catalyst. Further, a certain quantity of fuel must be supplied. If the stratified charge combustion is employed to satisfy these requirements, the quantity of fuel will be insufficient. With the homogeneous combustion, the retarded amount for the purpose of maintaining favorable combustion is small as compared to the case of stratified charge combustion. For these reasons, the above-described semi-stratified charge combustion is preferably employed in the catalyst warm-up operation, although either of stratified charge combustion and semi-stratified charge combustion may be employed.

Further, in the engine described in conjunction with FIGS. 11-14, the fuel injection timing by in-cylinder injector 110 is preferably set in the compression stroke for the reason set forth below. It is to be noted that, for most of the fundamental region (here, the fundamental region refers to the region other than the region where semi-stratified charge combustion is carried out with fuel injection from intake manifold injector 120 in the intake stroke and fuel injection from in-cylinder injector 110 in the compression stroke, which is carried out only in the catalyst warm-up state), the fuel injection timing of in-cylinder injector 110 is set at the intake stroke. The fuel injection timing of in-cylinder injector 110, however, may be set temporarily in the compression stroke for the purpose of stabilizing combustion, as will be described hereinafter.

When the fuel injection timing of in-cylinder injector 110 is set in the compression stroke, the air-fuel mixture is cooled by the fuel injection during the period where the temperature in the cylinder is relatively high. This improves the cooling effect and, hence, the antiknock performance. Further, when the fuel injection timing of in-cylinder injector 110 is set in the compression stroke, the time required starting from fuel injection up to the ignition is short, so that the air current can be enhanced by the atomization, leading to an increase of the combustion rate. With the improvement of antiknock performance and the increase of combustion rate, variation in combustion can be obviated to allow improvement in combustion stability.

Further, the warm map shown in FIG. 11 or 13 may be employed when in an off-idle mode (when the idle switch is off, when the accelerator pedal is pressed down), independent of the engine temperature (that is, independent of a warm state and a cold state). In other words, in-cylinder injector 110 is used in the low load region independent of the cold state and warm state.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A control apparatus for an internal combustion engine including a low-pressure pump supplying fuel of low pressure and a high-pressure pump supplying fuel of high pressure to a fuel injection mechanism from a fuel tank, said internal combustion engine including a first fuel injection mechanism injecting fuel into a cylinder and a second fuel injection mechanism injecting fuel into an intake manifold, and fuel can be supplied from said high-pressure pump and said low pressure pump to said first fuel injection mechanism, said control apparatus comprising:

a determination unit determining that an operation state of said internal combustion engine is in an idle state, and a control unit controlling said internal combustion engine, wherein said control unit controls said low-pressure pump, said high-pressure pump and said first and second fuel injection mechanisms depending upon which of three or more predetermined idle states said idle state belongs to based on a temperature of said internal combustion engine, said control unit effects any one of control such that said high-pressure pump is stopped and control such that a discharge pressure from said high-pressure pump is reduced when determination is made that the operation state is in said idle state, and said high-pressure pump being connected to a return line, the high-pressure pump and the return line being connected without a high-pressure delivery pipe therebetween.

2. The control apparatus for an internal combustion engine according to claim 1, wherein said control unit effects control such that fuel is injected from said second fuel injection mechanism when in a cold idle state.

3. The control apparatus for an internal combustion engine according to claim 1, wherein said control unit effects any one of control such that fuel is injected from said first fuel injection mechanism and control such that fuel is injected from said first and second fuel injection mechanisms when in a warm idle state.

4. The control apparatus for an internal combustion engine according to claim 3, wherein said control unit effects control such that a fuel injection ratio of said first fuel injection mechanism is increased as a temperature of said internal combustion engine becomes higher when fuel is to be injected from said first and second fuel injection mechanisms in said warm idle state.

5. The control apparatus for an internal combustion engine according to claim 3, wherein said control unit further includes an injection control unit effecting control such that, when fuel is injected from said first fuel injection mechanism in said warm idle state, a predetermined amount of fuel is injected from said first fuel injection mechanism and a differential amount from a required amount of injection is injected from said second fuel injection mechanism until the pressure of fuel supplied to said first fuel injection mechanism becomes less than a predetermined pressure.

6. The control apparatus for an internal combustion engine according to claim 3, wherein said control unit effects control such that fuel increased in pressure by said high-pressure pump is supplied to said first fuel injection mechanism and fuel is injected from said first fuel injection mechanism when in a high-temperature idle state higher in temperature than said warm idle state by at least a predetermined temperature.

7. A control apparatus for an internal combustion engine including a low-pressure pump supplying fuel of low pressure and a high-pressure pump supplying fuel of high pressure to a fuel injection mechanism from a fuel tank, said internal combustion engine including a first fuel injection mechanism injecting fuel into a cylinder and a second fuel injection mechanism injecting fuel into an intake manifold, and fuel can be supplied from said high-pressure pump and said low-pressure pump to said first fuel injection mechanism, said control apparatus comprising:

a determination unit determining that an operation state of said internal combustion engine is in an idle state, and a control unit controlling said internal combustion engine, wherein said control unit controls said low-pressure pump, said high-pressure pump and said fuel injection mechanisms depending upon which of three or more predetermined idle states said idle state belongs to based on a temperature of said internal combustion engine, effects any one of control such that said high-pressure pump is stopped and control such that a discharge pressure from said high-pressure pump is reduced when determination is made that the operation state is in said idle state, said high-pressure pump being connected to a return line, the high-pressure pump and the return line being connected without a high-pressure delivery pipe therebetween, effects control such that fuel is injected from said second fuel injection mechanism when in a cold idle state, and effects any one of control such that fuel is injected from said first fuel injection mechanism and control such that fuel is injected from said first and second fuel injection mechanisms when in a warm idle state.

8. The control apparatus for an internal combustion engine according to claim 1, wherein said first fuel injection mechanism is an in-cylinder injector, and said second fuel injection mechanism is an intake manifold injector.

9. A control apparatus for an internal combustion engine including a low-pressure pump supplying fuel of low pressure and a high-pressure pump supplying fuel of high pressure to a fuel injection mechanism from a fuel tank, said internal combustion engine including a first fuel injection mechanism injecting fuel into a cylinder and a second fuel injection mechanism injecting fuel into an intake manifold, and fuel can be supplied from said high-pressure pump and said low pressure pump to said first fuel injection mechanism, said control apparatus comprising:

determination means for determining that an operation state of said internal combustion engine is in an idle state, and control means for controlling said internal combustion engine, wherein said control means includes means for controlling said low-pressure pump, said high-pressure pump and said first and second fuel injection mechanisms depending upon which of three or more predetermined idle states said idle state belongs to based on a temperature of said internal combustion engine, said control means includes means for effecting any one of control such that said high-pressure pump is stopped and control such that a discharge pressure from said high-pressure pump is reduced when determination is made that the operation state is in said idle state, and said high-pressure pump being connected to a return line, the high-pressure pump and the return line are connected without a high-pressure delivery pipe therebetween.

10. The control apparatus for an internal combustion engine according to claim 9, wherein said control means includes means for effecting control such that fuel is injected from said second fuel injection mechanism when in a cold idle state.

11. The control apparatus for an internal combustion engine according to claim 9, wherein said control means includes means for effecting any one of control such that fuel is injected from said first fuel injection mechanism and control such that fuel is injected from said first and second fuel injection mechanisms when in a warm idle state.

12. The control apparatus for an internal combustion engine according to claim 11, wherein said control means includes means for effecting control such that a fuel injection ratio of said first fuel injection mechanism is increased as a temperature of said internal combustion engine becomes higher when fuel is to be injected from said first and second fuel injection mechanisms in said warm idle state.

13. The control apparatus for an internal combustion engine according to claim 11, wherein said control means further includes injection control means for effecting control such that, when fuel is injected from said first fuel injection mechanism in said warm idle state, a predetermined amount of fuel is injected from said first fuel injection mechanism and a differential amount from a required amount of injection is injected from said second fuel injection mechanism until the pressure of fuel supplied to said first fuel injection mechanism becomes less than a predetermined pressure.

14. The control apparatus for an internal combustion engine according to claim 11, wherein said control means includes means for effecting control such that fuel increased in pressure by said high-pressure pump is supplied to said first fuel injection mechanism and fuel is injected from said first fuel injection mechanism when in a high-temperature idle state higher in temperature than said warm idle state by at least a predetermined temperature.

15. A control apparatus for an internal combustion engine including a low-pressure pump supplying fuel of low pressure and a high-pressure pump supplying fuel of high pressure to a fuel injection mechanism from a fuel tank, said internal combustion engine including a first fuel injection mechanism injecting fuel into a cylinder and a second fuel injection mechanism injecting fuel into an intake manifold, and fuel can be supplied from said high-pressure pump and said low-pressure pump to said first fuel injection mechanism, said control apparatus comprising:

determination means for determining that an operation state of said internal combustion engine is in an idle state, and control means for controlling said internal combustion engine, wherein said control means includes means for controlling said low-pressure pump, said high-pressure pump and said fuel injection mechanisms depending upon which of three or more predetermined idle states said idle state belongs to based on a temperature of said internal combustion engine, means for effecting any one of control such that said high-pressure pump is stopped and control such that a discharge pressure from said high-pressure pump is reduced when determination is made that the operation state is in said idle state, said high-pressure pump being connected to a return line, the high-pressure pump and the return line being connected without a high-pressure delivery pipe therebetween, means for effecting control such that fuel is injected from said second fuel injection mechanism when in a cold idle state, and means for effecting any one of control such that fuel is injected from said first fuel injection mechanism and control such that fuel is injected from said first and second fuel injection mechanisms when in a warm idle state.

16. The control apparatus for an internal combustion engine according to claim 9, wherein said first fuel injection mechanism is an in-cylinder injector, and said second fuel injection mechanism is an intake manifold injector.

17. A control apparatus for an internal combustion engine including a low-pressure pump supplying fuel of low pressure and a high-pressure pump supplying fuel of high pressure to a fuel injection mechanism from a fuel tank, said internal combustion engine including a first fuel injection mechanism injecting fuel into a cylinder, and a second fuel injection mechanism injecting fuel into an intake manifold, and fuel can be supplied from said high-pressure pump and said low pressure pump to said first fuel injection mechanism, said control apparatus comprising an electronic control unit (ECU), wherein said electronic control unit (ECU)

determines that an operation state of said internal combustion engine is in an idle state, controls said low-pressure pump, said high-pressure pump, and said first and second fuel injection mechanisms depending upon which of three or more predetermined idle states said idle state belongs to based on a temperature of said internal combustion engine, and effects any one of control such that said high-pressure pump is stopped and control such that a discharge pressure from said high-pressure pump is reduced when determination is made that the operation state is in said idle state, said high-pressure pump being connected to a return line, the high-pressure pump and the return line being connected without a high-pressure delivery pipe therebetween.

18. A control apparatus for an internal combustion engine including a low-pressure pump supplying fuel of low pressure and a high-pressure pump supplying fuel of high pressure to a fuel injection mechanism from a fuel tank, said internal combustion engine including a first fuel injection mechanism injecting fuel into a cylinder and a second fuel injection mechanism injecting fuel into an intake manifold, and fuel can be supplied to said first fuel injection mechanism from said high-pressure pump and said low-pressure pump, said control apparatus comprising an electronic control unit (ECU), wherein said electronic control unit (ECU)

determines that an operation state of said internal combustion engine is in an idle state, determines which of three or more predetermined idle states said idle state belongs to based on a temperature of said internal combustion engine, effects any one of control such that said high-pressure pump is stopped and control such that a discharge pressure from said high-pressure pump is reduced when determination is made that the operation state is in an idle state, said high-pressure pump being connected to a return line, the high-pressure pump and the return line being connected without a high-pressure delivery pipe therebetween, effects control such that fuel is injected from said second fuel injection mechanism when in a cold idle state, and effects any one of control such that fuel is injected from said first fuel injection mechanism and control such that fuel is injected from said first and second fuel injection mechanisms when in a warm idle state.

* * * * *